US006725684B2

(12) United States Patent
Lee et al.

(10) Patent No.: US 6,725,684 B2
(45) Date of Patent: Apr. 27, 2004

(54) AIR CONDITIONER

(75) Inventors: Hae Rim Lee, Chinhae-shi (KR); Yong Woo Kim, Chinhae-shi (KR); Jae Buem Bae, Chinju-shi (KR); Yong Min Song, Pusan-shi (KR); Kam Gyu Lee, Pusan-shi (KR); Ju Ho Ock, Masan-shi (JP); Sung Jin Hwang, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/173,883

(22) Filed: Jun. 19, 2002

(65) Prior Publication Data

US 2002/0189274 A1 Dec. 19, 2002

(30) Foreign Application Priority Data

| | | |
|---|---|---|
| Jun. 19, 2001 | (KR) | P2001-34839 |
| Apr. 19, 2002 | (KR) | P2002-21625 |
| Apr. 19, 2002 | (KR) | P2002-21626 |
| Apr. 19, 2002 | (KR) | P2002-21627 |
| Apr. 19, 2002 | (KR) | P2002-21628 |

(51) Int. Cl.[7] ..... F25D 19/00; F25D 23/12

(52) U.S. Cl. ..... 62/298; 62/263

(58) Field of Search ..... 62/259.1, 262, 62/263, 298

(56) References Cited

U.S. PATENT DOCUMENTS

| | | | | |
|---|---|---|---|---|
| 4,458,502 A | * | 7/1984 | Adachi et al. | 62/259.1 |
| 5,600,963 A | * | 2/1997 | Koo et al. | 62/262 |
| 5,687,583 A | * | 11/1997 | Tunekawa et al. | 62/404 |

* cited by examiner

*Primary Examiner*—Denise L. Esquivel
*Assistant Examiner*—Malik N. Drake
(74) *Attorney, Agent, or Firm*—Birch, Stewart, Kolasch & Birch, LLP

(57) ABSTRACT

Disclosed is an air conditioner including a main chassis receiving various components inside, a heat exchanger installed inside the main chassis so as to exchange heat with a room air, a blow fan installed inside the main chassis so as to suck in and blow out the room air, a front panel attached to a front side of the main chassis and having an intake inlet at a front face so as to make an air flow in the heat exchanger, and an intake panel installed at the front face of the front panel to revolve to move so as to close/open the intake inlet selectively, the intake panel installed at the front face of the front panel so as to be detachable. The present invention enables to provide a compact air conditioner having an improved exterior.

62 Claims, 18 Drawing Sheets

AIR CONDITIONER

This application claims the benefit of the Korean Application No. P2001-34839 filed on Jun. 19, 2001, P2202-21615 filed on Apr. 19, 2002, P2002-21626 filed on Apr. 19, 2002, P2002-21627 filed on Apr. 19, 2002, and P2002-21628 filed on Apr. 19, 2002, which are hereby incorporated by reference.

BACKGROUND OF THE INVENTION

1. Field of the Invention

The present invention relates to an air conditioner, and more particularly, to an indoor unit of an air conditioner.

2. Discussion of the Related Art

Generally, an air conditioner is an apparatus for cooling an air for a pleasant air condition in a room by circulating the cooled air in the room. Air conditioners are divided into a one-body type air conditioner having all components built in one unit and a separate type air conditioner having all components built in outdoor and indoor units. The separate type air conditioners are divided into a wall-hanging type air conditioner hanging an indoor unit on a wall, a stand type air conditioner installing an indoor unit on a layer, and a ceiling-suspended type air conditioner having an indoor unit suspended at a ceiling or installing the indoor unit inside the ceiling.

FIG. 1 illustrates a bird's-eye view of an indoor unit of a general separate type air conditioner.

Referring to FIG. 1, an indoor unit of a general separate type air conditioner includes a main chassis 1 forming an exterior so as to be hung on an indoor wall surface, a front panel 3 installed at a front face of the main chassis 1, an intake grill 5*a* formed at the front panel 3, and a blow grill 7 installed at a lower end of the front panel 3. And, a display unit 9 is installed between the intake grill 5*a* and blow grill 7 so as to display a current operational status or guiding a user's operation. Besides, an additional intake grill 5*b* may be installed at an upper face of the main chassis 1.

Yet, the above-explained air conditioner according to a related art has the following problems or disadvantages.

First, since the main chassis 1 and front panel 3 protrude round toward a front side, a width between front and rear sides is considerably wide. Moreover, the intake grill 5*a* plays roles in protecting inner components of the indoor unit and guiding an external air, but becomes one of the reasons of increasing the width of the indoor unit as well as degrade the exterior of the indoor unit. Hence, the indoor unit according to the related art occupies too much room space as well as fails to provide a neat appearance.

Second, the intake grills 5*a* and 5*b* are always open in part, whereby particles such as dust and the like penetrate into the indoor unit through the intake grills.

Third, relation between reciprocal positions of the intake and blow grills 5*a* and 7 brings about interference between the sucked-in and blown airs. Namely, as both of the intake and blow grills 5*a* and 7 are located at the front face of the main chassis 1, the sucked-in air for heat-exchange is usually mixed with the heat-exchanged air. In this case, the heat-exchanged air having failed completely to circulate through the room is sucked in a heat exchanger 11 through the intake grill 5*a*, thereby reducing heat-exchange efficiency.

Fourth, a dead zone failing to be supplied with the heat-exchanged air is generated from a space right beneath the main chassis 1 due to the structure of the blow grill 7. It is a matter of course that a blowing direction of the heat-exchanged air can be adjusted by a vane or louver. It is impossible to supply the space beneath the main chassis 1 with the heat-exchanged air directly.

SUMMARY OF THE INVENTION

Accordingly, the present invention is directed to an air conditioner that substantially obviates one or more problems due to limitations and disadvantages of the related art.

An object of the present invention is to provide an air conditioner having a slimmer exterior.

Another object of the present invention is to provide an air conditioner enabling to prevent interference between one air before heat exchange and the other air after the heat exchange.

Another object of the present invention is to provide an air conditioner enabling to minimize the penetration of particles.

A further object of the present invention is to provide an air conditioner enabling to supply a room with a heat-exchanged air evenly.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an air conditioner according to the present invention includes a main chassis receiving various components inside, a heat exchanger installed inside the main chassis so as to exchange heat with a room air, a blow fan installed inside the main chassis so as to suck in and blow out the room air, a front panel attached to a front side of the main chassis and having an intake inlet at a front face so as to make an air flow in the heat exchanger, and an intake panel installed at the front face of the front panel to revolve to move so as to close/open the intake inlet selectively, the intake panel installed at the front face of the front panel so as to be detachable.

Preferably, a lower end of the intake panel is loaded on a lower portion of the front panel so as to revolve to move.

More preferably, the intake panel comprises a main plate and an auxiliary plate attached to a front face of the main plate.

More preferably, the auxiliary plate includes a first layer transmitting light and a second layer placed at a rear face of the first layer so as to reflect light.

More preferably, the first layer of the auxiliary plate is made of one selected from a group consisting of tempered glass and plastics.

More preferably, the second layer of the auxiliary plate is selected from a group consisting of a metal layer and dielectric multi-layers.

More preferably, the second layer is colored with a predetermined color.

More preferably, the auxiliary plate includes various patterns and colors.

Preferably, the intake panel maintains a predetermined tilt angle for the front panel on operation.

More preferably, the intake panel further comprises a driving means connecting the front panel and the intake panel to each other when the intake panel is detached and revolving the intake panel up to a limited range on operation.

More preferably, the driving means includes a first link having a first end portion connected to the front panel to move to revolve and a second link having a first end portion connected to a second end portion of the first link confronting the first end portion of the first link and a second end portion connected to the intake panel so as to revolve to move.

More preferably, a connecting unit of the first and second links includes a hinge hole formed one of the second end portion of the first link and the first end portion of the second link and a hinge pin formed at the other end portion connected to the end portion having the hinge hole so as to be inserted in the hinge hole.

More preferably, a connecting unit of the second link and intake panel includes a bracket formed at a rear face of the intake panel and having a hinge hole and a hinge pin inserted in the hinge hole at the second end portion of the second link, the hinge hole of the bracket, and the hinge hole of the second link, simultaneously.

More preferably, the driving means further comprises a motor connected to the first end portion of the first link so as to revolve the first link automatically.

More preferably, the motor is a step motor enabling to control a revolution degree of the first link step by step.

More preferably, the motor is attached to a rear face of the front panel and the first link is connected to a shaft of the motor through an opening formed at the front panel.

More preferably, the front panel further comprises a partition formed near the opening so as to protect the inner components.

More preferably, the partition extends from a circumference of the opening toward a rear side of the front panel in a direction vertical to the front face of the front panel.

More preferably, the driving means further comprises an auxiliary connecting member formed at the connecting unit of the first and second links so as to prevent separation of the first and second links.

More preferably, the auxiliary connecting member is formed at one of a group consisting of the second end portion of the first link and the first end portion of the second link so as to surround the other connected end portion in part.

More preferably, the auxiliary connecting member includes a boss formed near one of the second end portion of the first link and the first end portion of the second link and a coupling member coupled with the boss so as to gear into the other end portion connected to the end portion having the boss.

More preferably, the driving means further comprises a stopper formed at the connecting unit of the first and second links so as to restrict a reciprocal revolution range between the first and second links.

Preferably, a loading unit of the intake and front panels includes a hinge bar formed at a lower side of the front panel and a hinge ring protruding from a lower end of the intake panel so as to be coupled with the hinge bar detachably.

Preferably, the air conditioner further includes a power control means for cutting off a power to the inner components when the intake panel is separated.

More preferably, the power control means includes a protrusion formed at a lower end of the intake panel so as to be inserted in a hole formed at the front panel on loading a panel and a switch fixed to the front panel by a predetermined fixing member so as to supply a power by being contacted with the protrusion.

More preferably, a contact area between the protrusion and the switch is a curved face.

More preferably, the switch includes a body having an electrical contact point and a terminal having one end connected to the body and the other end contacted with the contact point of the body when being pressurized.

More preferably, the fixing member includes a hook formed inside the front panel so as to be adjacent to a recess for the protrusion wherein the switch is inserted in the hook and a plurality of ribs supporting the switch.

Preferably, the air conditioner further includes a blow means installed at the main chassis so as to blow the heat-exchanged air into a room by being drawn inside or outside the main chassis.

Preferably, the main chassis further comprises a blow outlet formed at a bottom face.

Preferably, the main chassis further comprises a front part and a rear part installed at a wall face so as to lead to the front part.

In another aspect of the present invention, an air conditioner includes a main chassis receiving various components inside, a heat exchanger installed inside the main chassis so as to exchange heat with a room air, a blow fan installed inside the main chassis so as to suck in and blow out the room air, a front panel attached to a front side of the main chassis and having an intake inlet at a front face so as to make an air flow in the heat exchanger, and an intake panel installed at the front face of the front panel to revolve to move so as to close/open the intake inlet selectively, the intake panel installed at the front face of the front panel so as to be detachable, the intake panel hung on the front panel when being detached.

Accordingly, the indoor unit of the air conditioner according to the present invention can have a compact size as well as improves its exterior.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
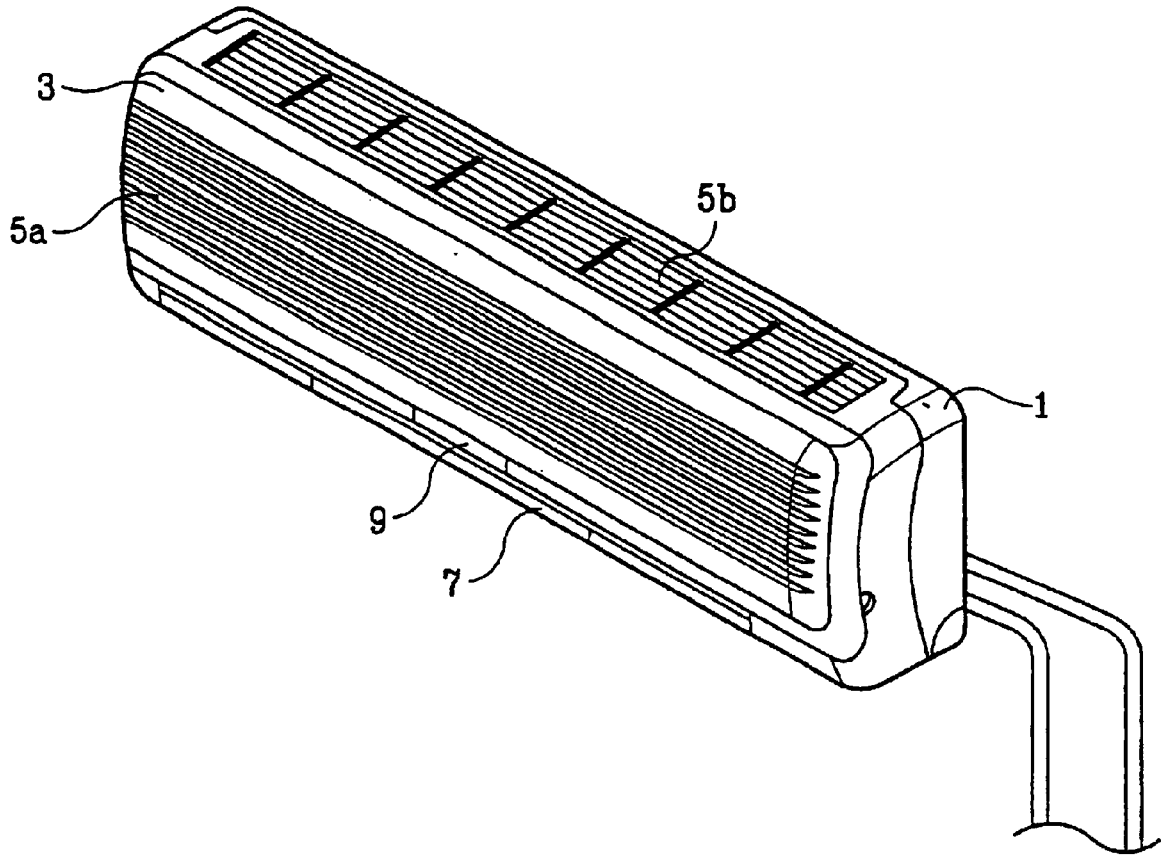
FIG. 1 BACKGROUND ART
FIG. 1 illustrates a bird's-eye view of an indoor unit of a general separate type air conditioner.
Figure 2:
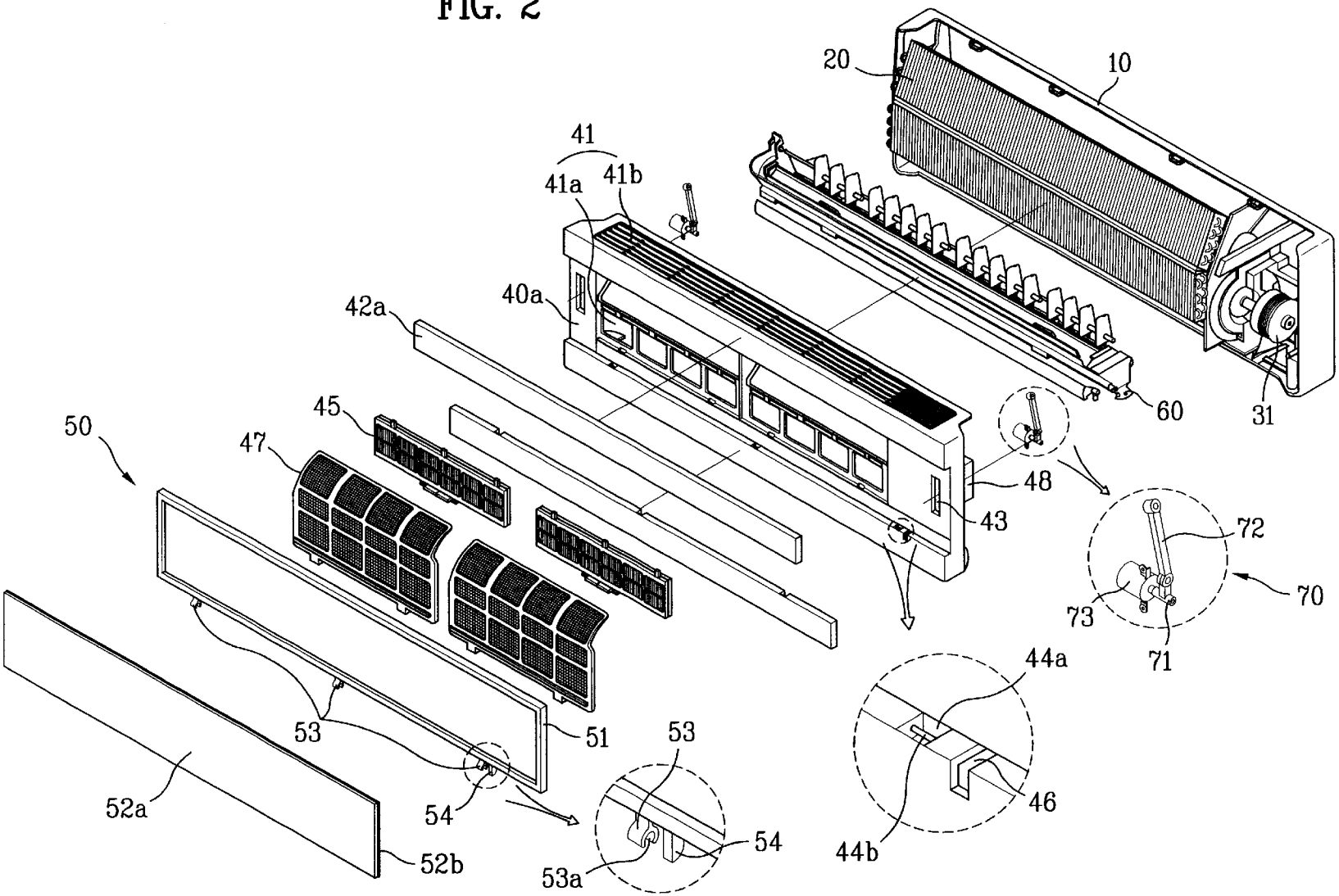
FIG. 2 illustrates a bird's-eye view of a disassembled indoor unit of an air conditioner according to the present invention.
Figure 3A:
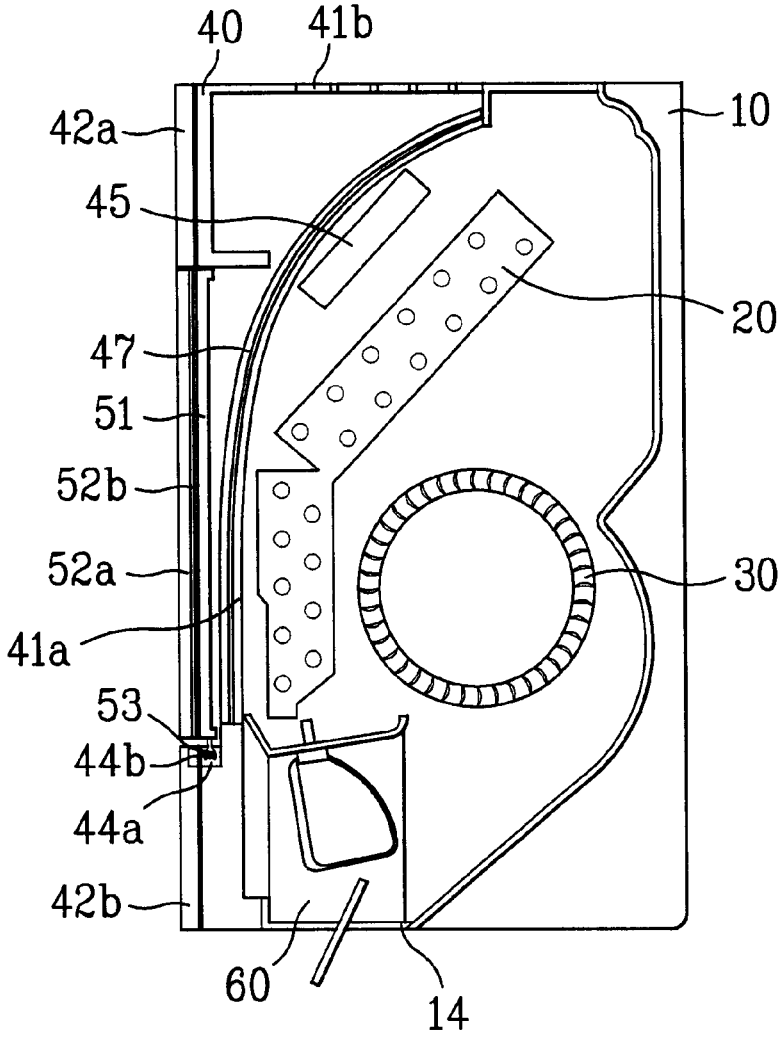
FIG. 3A and FIG. 3B illustrate cross-sectional views of an indoor unit of an air conditioner according to the present invention.
Figure 3B:
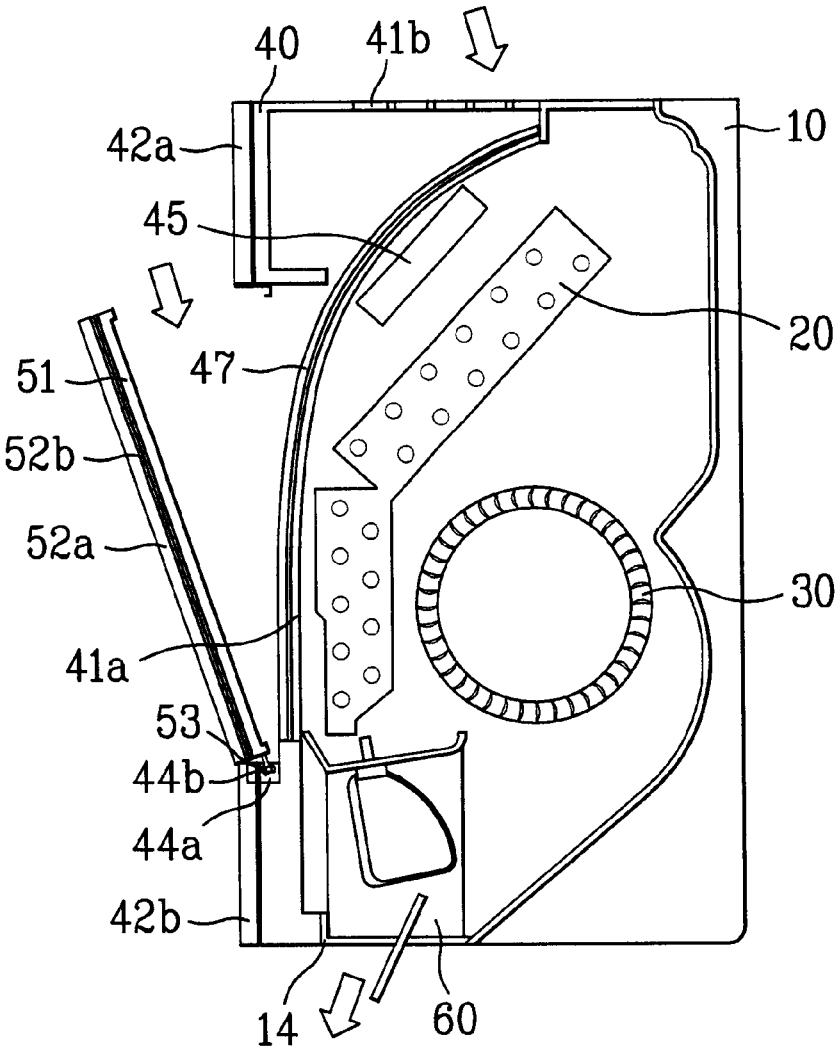

FIG. 2 illustrates a bird's-eye view of a disassembled indoor unit of an air conditioner according to the present invention, and FIG. 3A and FIG. 3B illustrate cross-sectional views of an indoor unit of an air conditioner according to the present invention.

Air conditioners are divided in general into a one-body type air conditioner having all components built in one unit and a separate type air conditioner having all components built in outdoor and indoor units. In the following written description, the present invention explains embodiments applied to the separate type air conditioner. Besides, an outdoor unit of an air conditioner according to the present invention has the same constitution of a general outdoor unit, for which explanation is skipped in the following description.

Referring to FIG. 2 to FIG. 3B, an indoor unit of an air conditioner according to the present invention includes a main chassis 10, a heat exchanger 20 installed inside the main chassis 10, a blow fan 30 installed inside the min chassis 10, a front panel 40 installed in front of the main chassis 20, and an intake panel 50 installed at a front face of the front panel 40.

First of all, the main chassis 10 is basically constituted so as to receive various components for the operation of the indoor unit. A blow outlet 14 is formed at a bottom of the main chassis 10 so as to blow an air having heat-exchanged on the indoor unit, and a blow assembly 60 is loaded on the blow outlet 14. The blow assembly 60 includes a vane, a louver, or the like so as to adjust a blow direction of the heat-exchanged air right and left as well as upward and downward. The blow outlet 14 and blow assembly 60, as shown in FIG. 3A and FIG. 3B, enable to blow an air to a right lower area of the indoor unit, thereby preventing the interference between an intake airflow and a blown airflow through a front face of the indoor unit as well as being advantageous in cooling an area below the indoor unit. Moreover, the blow outlet 14 is formed at the bottom face of the indoor unit instead of the front face, thereby improving a front exterior of the indoor unit.

Figure 5A:
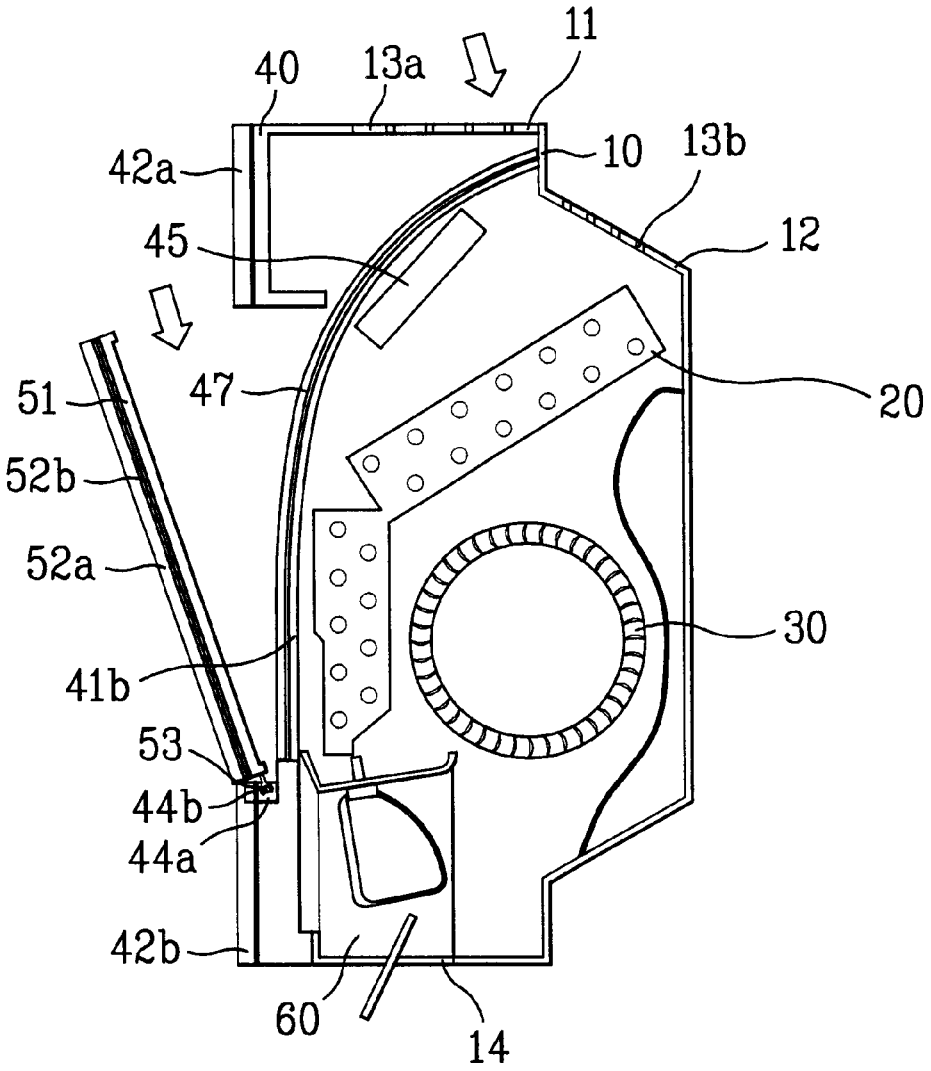
FIG. 5A and FIG. 5B illustrate cross-sectional and bird's-eye views of a modification of a main chassis in an indoor unit of an air conditioner according to the present invention.
Figure 5B:
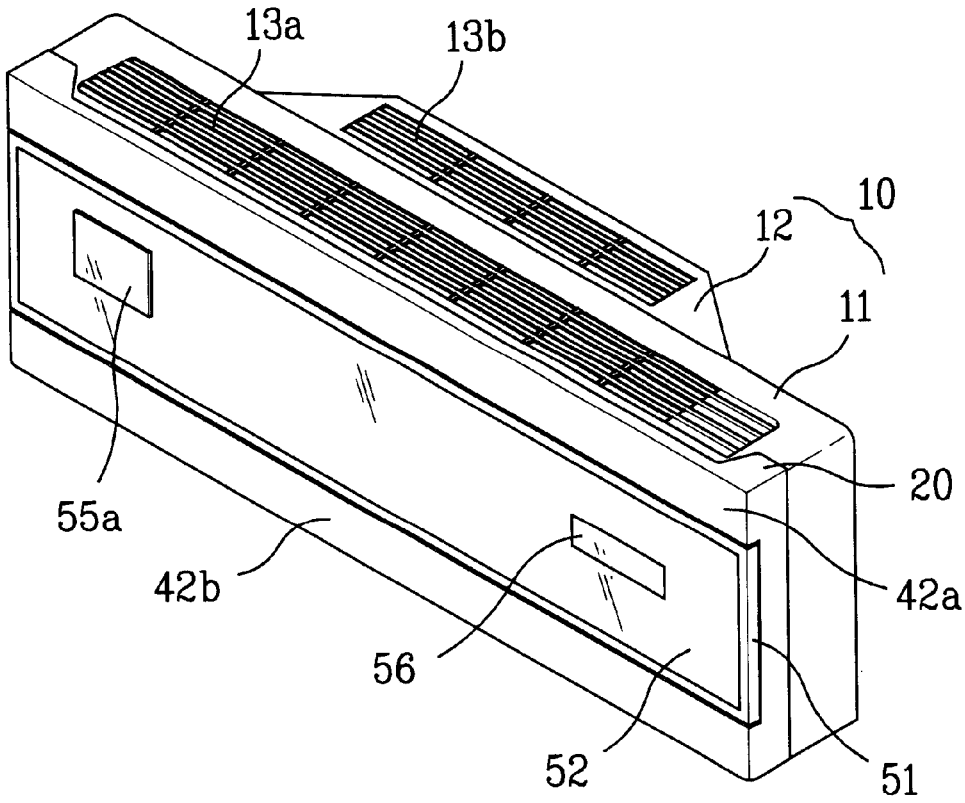

Moreover, the main chassis 10, as shown in FIGS. 5A and 5B, can have a doubled structure including a front part 11 and a rear part 12 installed at a wall face of a room. The front and rear parts are interconnected, and the heat exchanger 20, blow fan 30 and the like are installed in a space between the front and rear parts 11 and 12.

Specifically, the front part 11 is rectangular in figure, and the blow outlet 14 is formed at a bottom of the front part 11. Besides, the front part 11 can be built in one body of the front panel 40.

The rear part 12 protrudes from a back face of the front part 11, and has upper/lower and right/left widths which are narrower than those of the front part 11. Hence, if the rear part 12 is hanged on the wall of the room, a user mainly sees the front part 11. Thus, it is recognized that an exterior of the indoor unit looks slim visually. Specifically, if a concave recess is formed at the room wall so as to correspond to the rear part 12, the indoor unit occupies a less space since the front part 11 protrudes out of the wall face of the room only. Moreover, the rear part 12 can be a member separable from the front part 11, or built in one body of the front part 12.

Besides, extra intake inlets 13*a* and 13*b* can be formed at upper faces of the front and rear parts 11 and 12 so as to improve an intake efficiency. In order to guide intake airflow smoothly, the intake inlets 13*a* and 13*b* may further include an intake grill.

The heat exchanger 20 exchanges heat with a room air sucked into the indoor unit through an operational fluid such as a refrigerant flowing inside the heat exchanger 20. The blow fan 30 is generally located in a rear of the heat exchanger 20, and revolves by a motor 31 so as to circulate the room air forcibly through the indoor unit. Namely, the blow fan 30 sucks the room air inside the indoor unit so that the heat exchanger 20 exchanges heat with the room air and discharges the heat-exchanged air outside the indoor unit. In this case, the heat exchanger 20, as shown in FIG. 3A, FIG. 3B, and FIG. 5A, has a properly bent shape so as to carry out the heat exchange on the entire room air sucked in through the intake inlets formed at the upper side of the indoor unit as well as at the front part of the indoor unit.

The front panel 40 basically seals a front face of the main chassis 10 so as to provide a space in which various components such as the heat exchanger 20, blow fan 30, and the like are installed together with the main chassis 10. A main intake inlet 41*a* is formed at a front face of the front panel 40 so as to make the room air sucked inside the heat exchanger 20. Besides, an auxiliary intake inlet 141*b* can be formed at an upper side of the front panel 40 instead of the upper intake inlets 13*a* and 13*b* of the main chassis 10. Moreover, a recess portion 40*a* is formed at a front face of the front panel 40 for the intake panel 50 so as to be recessed inside, and decoration panels 42*a* and 42*b* are installed at upper and lower sides of the recess portion 40*a*. The decoration panels include various colors and patterns so as to decorate the front face of the indoor unit, and make the front face of the indoor unit flat together with the intake panel 50 so as to improve an exterior of the air conditioner. The decoration panels 42*a* and 42*b* can be built in one body of the front panel 40. Moreover, an electrostatic precipitator 45 and an air filter 47 are installed at the main intake inlet 41*a* so as to purify the intake air. Besides, the front panel 40, if necessary for design, can be built in one body of the main chassis 10.

The intake panel 50 is made of a plane member enabling to cover the main intake inlet 41*a* entirely so as to open/close the main intake inlet 41*a* selectively. For this, the intake panel 50 is basically installed at the front panel 40 so as to move revolvably. Specifically, a lower end portion of the intake panel 50 is hinge-connected to a lower front face of the front panel 40. The intake panel 50 revolves centering around the lower end portion so as to open the main intake inlet 41*a* on operating the air conditioner or close the main intake inlet 41*a* on stopping the operation of the air conditioner. Compared to a general blow grill, the intake panel 50 is made of a thin plane member so as to make the indoor unit compact overall. Besides, the planarized front face of the intake panels improves the exterior of the indoor unit. And, the intake panel 50 closes the main intake inlet 41*a* completely when the air conditioner stops operating, thereby enabling to prevent penetration of the particles through the main intake inlet 41*a*. Moreover, the intake panel 50 and front panel 40 are connected to each other through hinge, whereby the present invention enables to close/open the main intake inlet 41*a* with such a relatively simple structure.

More specifically, the intake panel 50, as shown in FIG. 2, may include a main plate 51 loaded on the front panel 40 and an auxiliary plate 52 attached to a front face of the main plate 51. In this case, a cavity portion is preferably formed at the main plate 51 for the auxiliary plate 52. And, the auxiliary plate 52 can be made of a double-structured or single-structured member.

The auxiliary plate 52 as the double-structured member may include a first layer 52*a* and a second layer 52*b* located at a rear side of the first layer 52*a*. The first layer 52*a* is made of tempered glass or transparent plastics so as to transmit light. And, the second layer 52*b* reflects the lights transmitted by the first layer 52*a* and is made of a metal film or dielectric multi-layers. The metal film is an Ag or Al layer coated on a grinded rear face of the first layer 52*a*, and the dielectric multi-layers are deposited on the rear face of the first layer 52*a*. In such an auxiliary plate 52, light incident on the front face of the indoor unit permeates the first layer 52*a* so as to be reflected on the second layer 52*b*, whereby the intake panel 50 works as a mirror. Moreover, the second layer 52 can be colored by a predetermined color, and such a color appears through the transparent first layer 52*a*. Meanwhile, the auxiliary plate 52 as the single-structured member can include various forms of patterns and colors. Specifically, the pattern and color of wood grain gives elegance to the indoor unit. Hence, the exterior of the air conditioner can be improved better by the auxiliary plate 52.

Figure 4A:
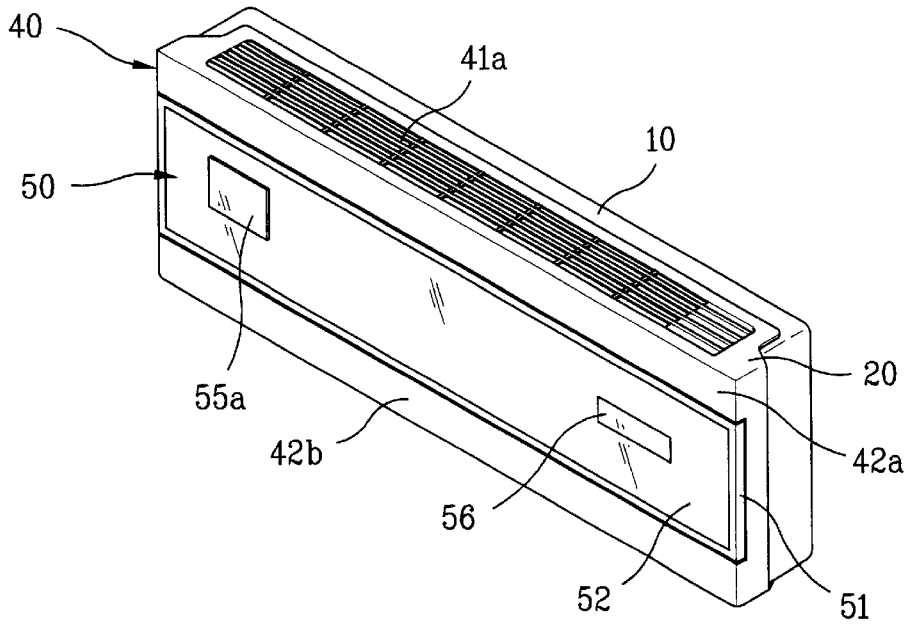
FIG. 4A and FIG. 4B illustrate bird's-eye views of an indoor unit of an air conditioner according to the present invention.
Figure 4B:
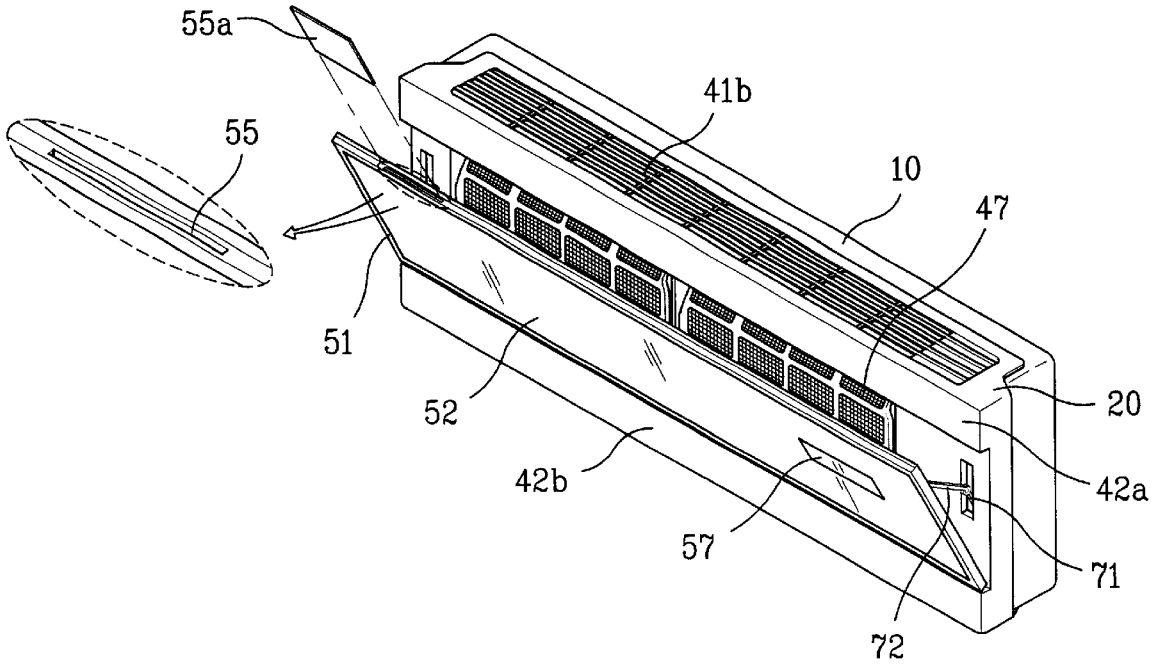

An insertion slot 55, as shown in FIG. 4A and FIG. 4B, can be formed at the intake panel 50 so that prints 55*a* such as a picture and the like can be inserted in the slot. And, a display unit 56 displaying an operational status of the air conditioner can be installed at the intake panel 50 as well. The insertion slot 55 and display unit 56 improve the exterior of the air conditioner as well as give the intake panel 50 more various usages.

Meanwhile, when the intake panel 50 becomes fully open, the main intake inlet 41*a* is exposed entirely so as to degrade the exterior of the indoor unit. Hence, the intake panel 50, as shown in FIGS. 3B and 4B, preferably revolves to a predetermined angle from the front panel 40. Namely, when the air conditioner operates, the intake panel 50 maintains a uniform tilt angle for the front panel 40. Such a tilted intake panel 50, as shown in FIG. 3B, is located between the main intake inlet 41*a* and blow outlet 14. Hence, the intake and blow flows through the intake inlet 1*a* and blow outlet 14 are substantially separated from each other as well as fail to interfere with each other. Moreover, as the indoor unit is placed at a high position on a wall surface as well as looked up by a user, the tilted intake panel 50 enables to cover the open main intake inlet 41*a* so as not to be seen. Moreover, the user enables to see the display unit 56 and the like installed at the intake panel 50 more vividly.

In order to maintain the uniform tilt angle, the intake panel 50 further includes a driving means 70 supporting the intake panel 50 and simultaneously restricting revolution of the intake panel 50. Various mechanisms can be used as the driving means 70, and a link mechanism is applied to an embodiment of the present invention. As an overall length of the link is limited even if the link mechanism is fully unfolded, such a link driving means 70 permits a revolution of the intake panel as long as the limited link length. Besides, when the intake panel reaches its maximum revolution, the link driving means 70 supports (restricts) the intake panel 50 so as not to revolve any more.

Figure 6:
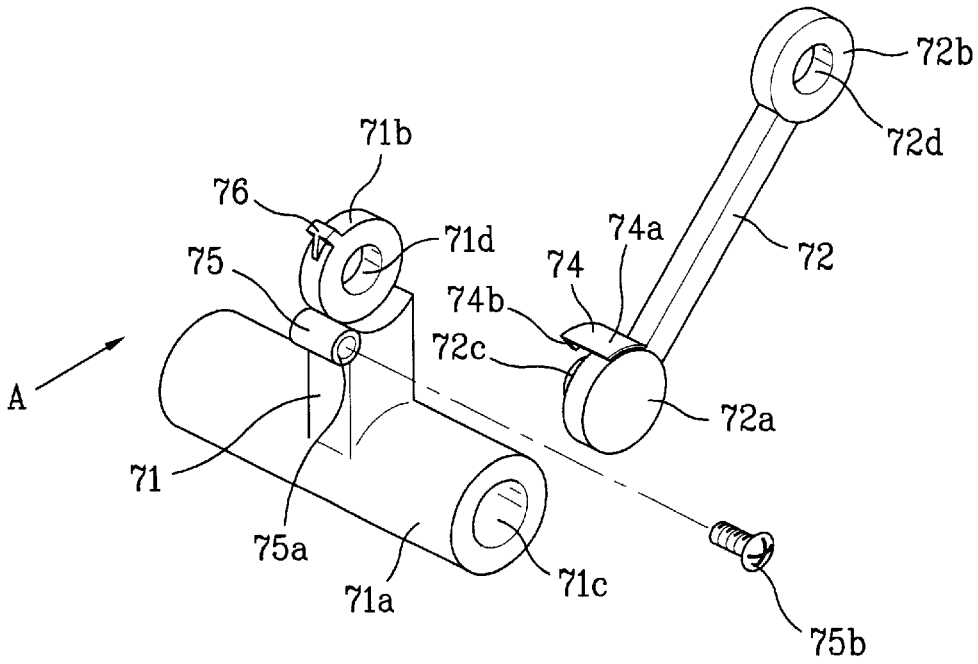
FIG. 6 illustrates a bird's-eye view of a disassembled intake panel driving means of an air conditioner according to the present invention.
Figure 7:
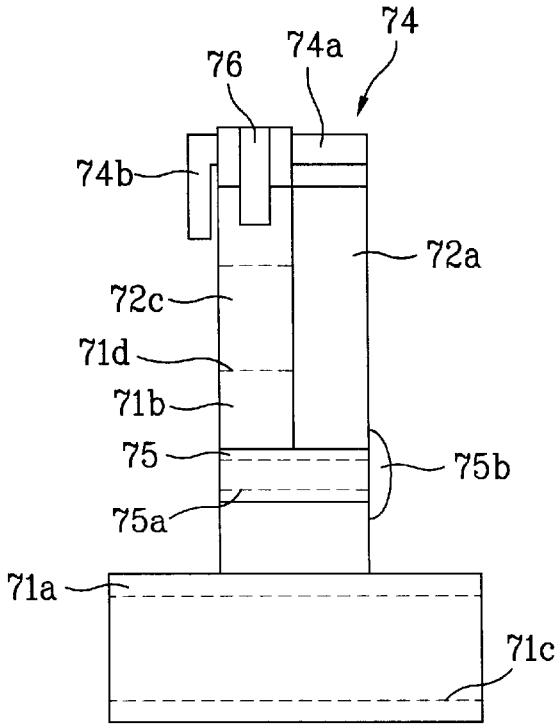
FIG. 7 illustrates a front view of a driving means assembly seen from a direction 'A' in FIG. 6.

The driving means 70, as shown in FIG. 2, FIG. 6, and FIG. 7, includes a first link 71 connected to the front panel 40 and a second link 72 connecting the first link 71 to the intake panel 50.

Figure 8A:
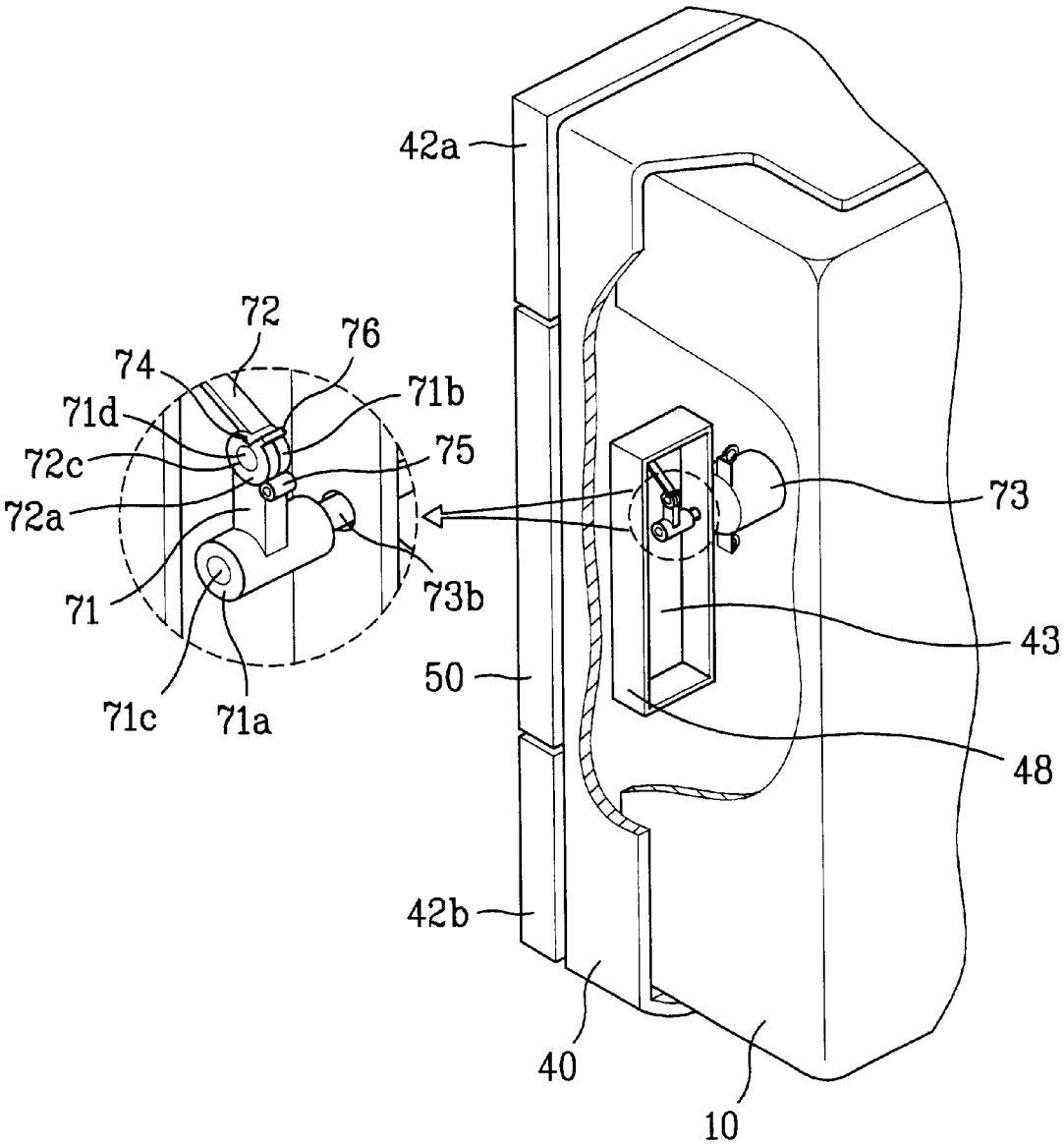
FIG. 8A and FIG. 8B illustrate partially open bird's-eye views of an intake panel driving means loaded on an air conditioner according to the present invention.
Figure 8B:
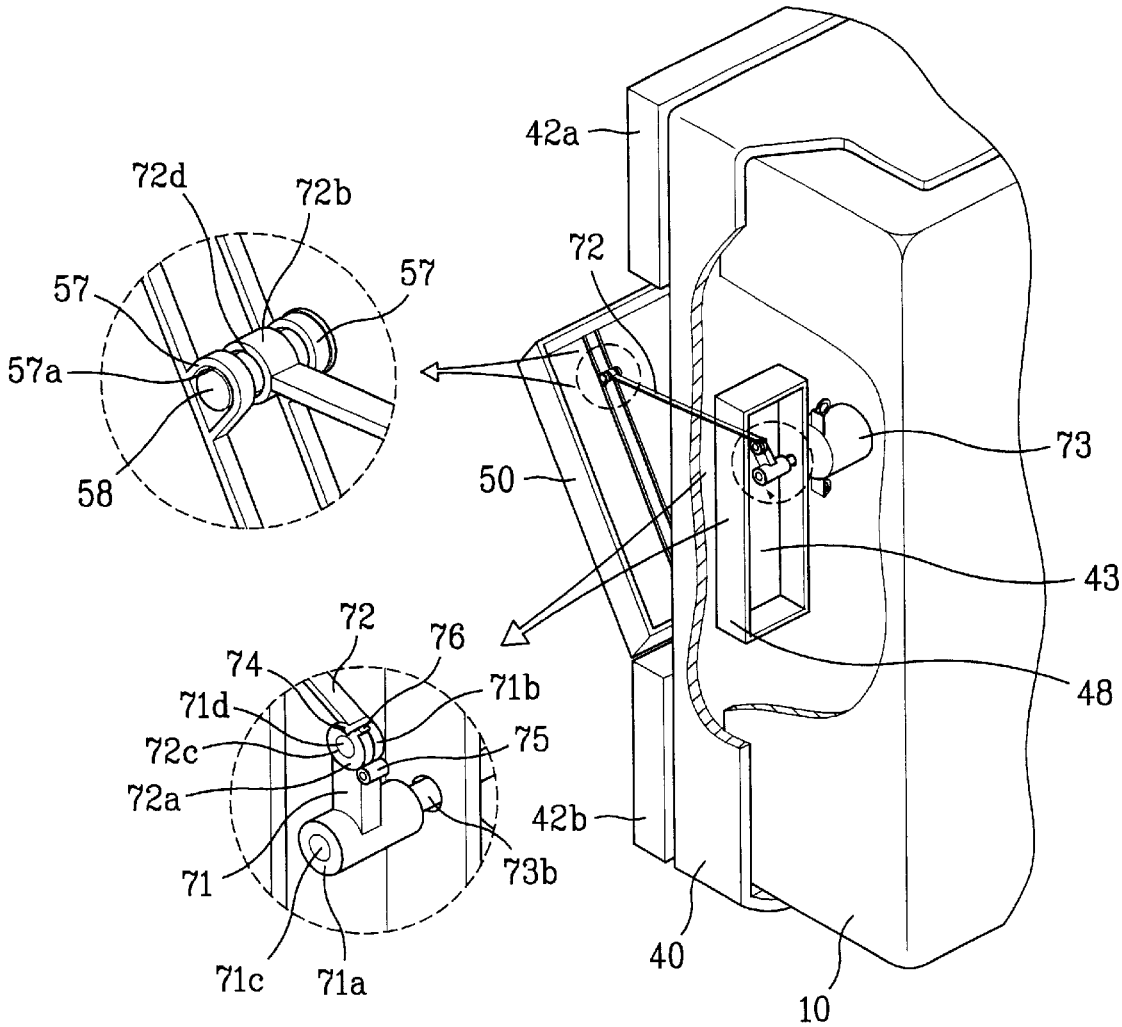

In this case, the first link 71 includes a first end portion 71*a* connected to the front panel 40 revolvably and a second end portion 71*b* connected to the second link 72 revolvably so as to confront the first end portion 71*a*. And, the second link 72 includes a first end portion 72*a* connected to the second end portion 71*b* of the first link 71 and a second end portion 72*b* connected to the intake panel 50 revolvably. Specifically, a connecting unit of the first and second links 71 and 72, as shown in FIG. 6, FIG. 7, and FIG. 8A, includes a hinge hole 71*d* formed at the second end portion 71*b* of the first link 71 and a hinge pin 72*c* formed at the first end portion 72*a* of the second link 72 so as to be inserted in the hinge hole 71*d*. In such a connecting unit, the hinge pin 72 is pulled out of or inserted in the hinge hole 71*d*, whereby the first and second links 71 and 72 can be disassembled from each other with ease. Namely, the simply structured connecting unit enables the intake panel 50 to be repaired or replaced easily. On the contrary, the hinge hole and pin can be formed at the second and first links 72 and 71, respectively. Moreover, the other connecting unit of the second link 71 and intake panel 50, as shown in FIG. 8B, includes a bracket 57 formed at the rear face of the intake panel 50 so as to include the hinge hole 57*a*, another hinge hole 72*d* formed at the second end portion 72*b* of the second link 72, and another hinge pin 58 inserted into both of the bracket and the hinge holes 55*a* and 72*d* of the second link. As similar to the first and second link connecting unit, the intake panel 50 and second link 72 can be easily disassembled by removing the hinge pin 58 so as to enable their easy repair and replacement.

The user can operate the intake panel 50 together with the above-described driving means 70. Yet, it is preferable that the intake panel 70 revolves automatically for user's sake of convenience. For this, the driving means 70 further includes a motor 73 giving a driving force to the first and second links 71 and 72. Specifically, a shaft of the motor 73, as shown in FIGS. 8A and 8B, is inserted in a hole 71*c* of the first end portion 71*a* so that the motor 73 is connected to the first link to be inter-driven with the first link. Moreover, the motor 73 is preferably a step motor so as to control revolution of the first link 71 step by step. Hence, as the revolution and tilt angle of the intake panel 50 are adjusted to change an interval between the intake panel 50 and main intake inlet 41*a*, whereby intake airflow through the main intake inlet 41*a* is adjusted. If the motor 73 is installed, a space between the intake panel 50 and front panel 40 is limited. Hence, the motor 73, as shown in FIG. 8A and FIG. 8B, is preferably installed at the rear face of the front panel 40 and the first link 71 is connected to the motor 73 through an opening 43 formed at the front panel 40. Such an installment structure prevents the motor 73 from being exposed when the main intake inlet 41*a* becomes open, thereby improving the exterior or appearance of the air conditioner. It is advantageous that the opening 43 extends long upper to lower side, whereby the first and second links 71 and 72 can move smoothly. Yet, a size of the opening 43 increases so that a finger or other member can be inserted therein. Preferably, the front panel 40 further includes a partition 48 around the opening 43. The partition 48, as shown in FIG. 8A and FIG. 8B, extends from a circumference of the opening 43 toward a rear side of the front panel 40. Moreover, the partition 48 may extend from the circumference of the opening 43 in a direction vertical to the front face of the front panel 50. Yet, it is more advantageous that the partition 43 is formed to be inclined inward the opening 43 so as to reduce the size of the opening 43. Hence, it is prevented that the partition 48 approaches the components built in the indoor unit, whereby the user fails to receive an electric shock due to a contact between finger/external member and the component. Besides, malfunction of the components is prevented.

Moreover, the first and second links 71 and 72 having the above-explained simple connecting unit may be disassembled during operation. Hence, the driving unit preferably further includes auxiliary connecting members formed at the connecting unit of the first and second links 71 and 72. First of all, one of the auxiliary connecting members, as shown in FIG. 6 and FIG. 7, is a guide 74 formed at the second link 72. The guide 74 includes a horizontal member 74*a* extending from the first end portion 72*a* of the second link 72 along the second end portion 71*b* of the first link 71 and a vertical member 74*b* extending from the horizontal member 74*a* so as to cover a side face of the second end portion 71*b*. Namely, the guide 74 surrounds partially the second end portion 71*b* overall so as to prevent the second end portion 71*b* from deviating from the first end portion 72*a* of the second link 72. The guide 74 may be formed at the second end portion 71*b* of the first link 71 with the same shape. Moreover, the auxiliary connecting member, as shown in the drawing, may include a boss 75*a* formed near the second end portion 71*b* of the first link 71 and a coupling member 75*b* coupled with the boss 75*a*. As shown in detail in FIG. 7, the coupling member 75*b* is coupled with the boss 75*a* so as to gear into or contact with the first end portion 72*a* of the second link 72. Hence, the first end portion 72*a* is not separated from the second end portion 71*b* in a rotational shaft direction during operation. And, the boss 75*a*, as is the case with the guide 74, can be formed near the first end portion 72*a* of the second link 72 instead of the second end portion 71*b*.

Finally, the driving means 70, as shown in FIG. 6 and FIG. 7, may further include a stopper 76 formed at the connecting unit of the first and second links 71 and 72. The connecting unit of the first and second links 71 and 72 allows the first and second links 71 and 72 to revolve freely, whereby the first and second links 71 and 72 revolve relatively only but the intake panel 50 may revolve no more. This phenomenon may occur possibly if a little external force is applied to the intake panel 50 during revolution. Hence, the stopper 74 protrudes from the second end portion 71*b* of the first link 71, as shown in FIG. 8B, whereby the second link 72 is caught on the stopper 74 during revolution so as to restrict the relative revolution of the second link 72 for the first link 71. Specifically, the stopper 76 substantially maintains the angle between the first and second links 71 and 72 so as to be smaller than 180°. Therefore, the stopper 76 secures the stable revolution of the intake panel 50.

Figure 9A:
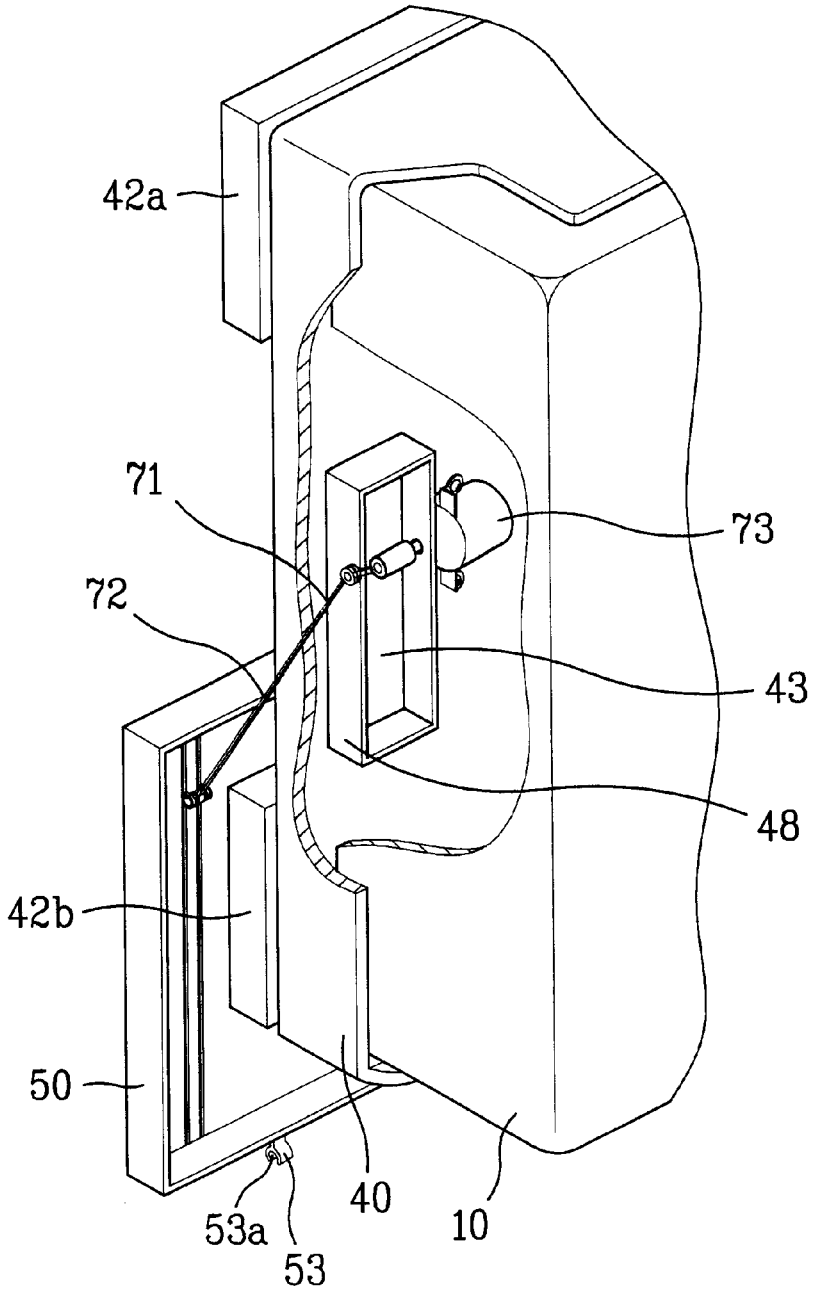
FIG. 9A and FIG. 9B illustrate partially open and bird's-eye views of an air conditioner from which an intake panel is detached according to the present invention.
Figure 9B:
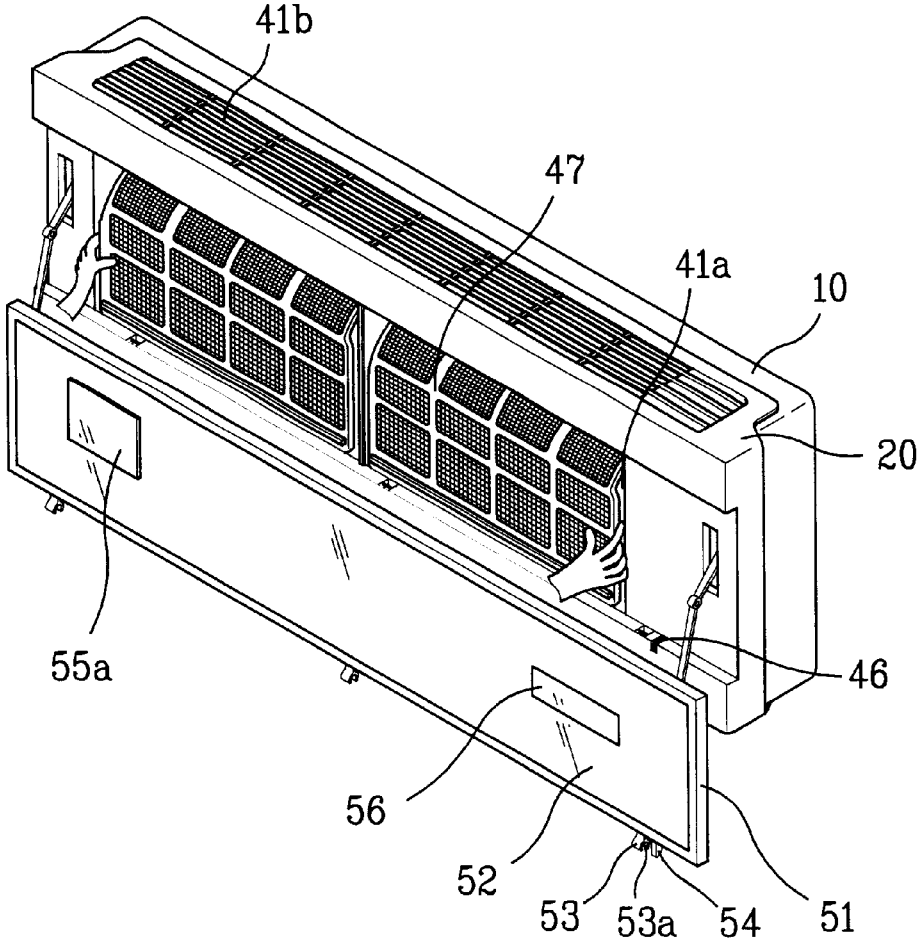

Particles such as dust and the like are generally accumulated from the sucked air inside the air conditioner having been used for a predetermined time. For user's health, inner components such as the air filter 47 and the like need to be cleaned. For easy cleaning, the intake panel 50 is preferably detachable from the front panel 40. For this, a loading unit of the intake and front panels 50 and 40, as shown in FIG. 2, FIG. 3A, FIG. 3B, and FIG. 5A, includes a hinge bar 44*b* formed at a lower part of the front panel 50 and a hinge ring 53 protruding at a lower end of the intake panel 50. In this case, the hinge bar 44*b* is installed in a groove having a predetermined size for smooth revolution of the hinge ring 53. And, the hinge ring 53 has a partially open shape 53*a* so as to be detachable from the hinge bar 44*b*. With such a structure of the loading unit, the intake panel 50, as shown in FIG. 9A and FIG. 9B, is easily separated from the front panel 40 so as to expose the main intake inlet 41*a* entirely. Hence, the air filter 47 is separated so as to be cleaned. Moreover, the separated intake panel 50 is hung on the front panel 40 by the driving means, i.e. the first and second links 71 and 72, thereby the intake panel 50 can be reloaded with ease.

Since the inner component driven by high voltage such as the electrostatic precipitator 45 adjacent to the air filter 47 is exposed while the air filter 47 is disassembled, the user may receive an electric shock. For user's safety, the intake panel 50 further includes a power control unit cutting off a power of the inner component when the intake panel 50 is disassembled. The power control unit, as shown in FIG. 2 and FIGS. 10A to 10C, includes a protrusion 54 formed at a lower end of the intake panel 50 and a power switch 100 fixed inside the front panel 40 through a predetermined fixing member. In this case, the protrusion 46, when the intake panel 50 is loaded on the front panel 40, is inserted in a penetrating hole 46 formed at the front panel 40 so as to reach an lower inside of the front panel 40. And, a lower face of the protrusion 54 is formed to have a curved shape so as to come into contact smoothly with the switch 100 continuously while the intake panel 50 revolves. The switch 100 is a kind of relay switch connected between the inner components and power supply, and includes a body 110 and a terminal 120 connected to the body 110 and having elasticity. Specifically, one end of the terminal 120 is connected to the body 110, and the other end comes into contact with the body 110 when being pressurized. Electrical contact points 111 and 121 are installed at the body 110 and the other end of the terminal 120, respectively. When the other end of the terminal 120 is contacted with the body 110, the contact points 111 and 121 are connected to each other. Moreover, the switch 100 is fixed stably by a hook 49*a* formed inside the front panel 40 adjacent to the penetrating hole 46 and ribs 49*b* located in rear of the switch. The hook 49*a* provides a recessed part in which the switch is inserted, and the ribs 49*b* support the switch 100 pressurized by the protrusion 54 so as not to be pushed.

Figure 10A:
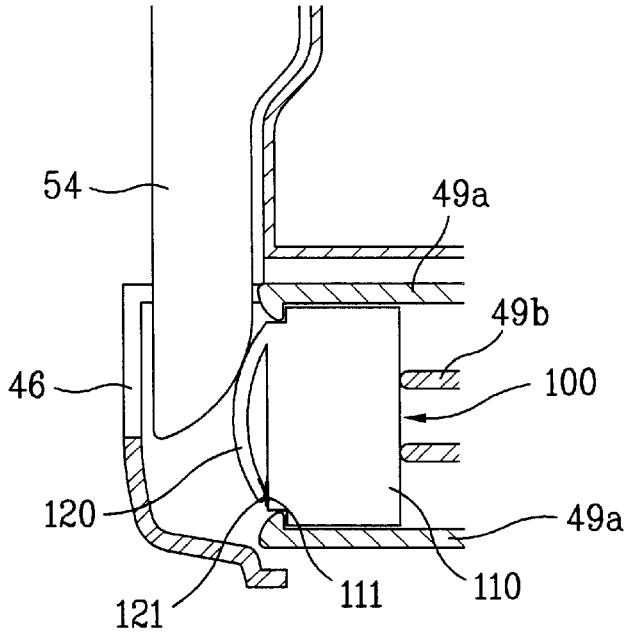
FIGS. 10A to 10C illustrate cross-sectional views of a power control means in part according to the present invention.
Figure 10B:
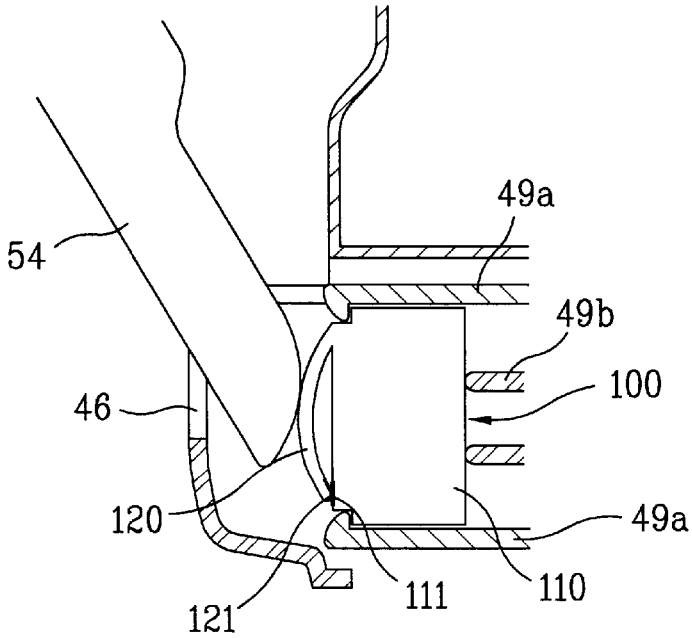
Figure 10C:
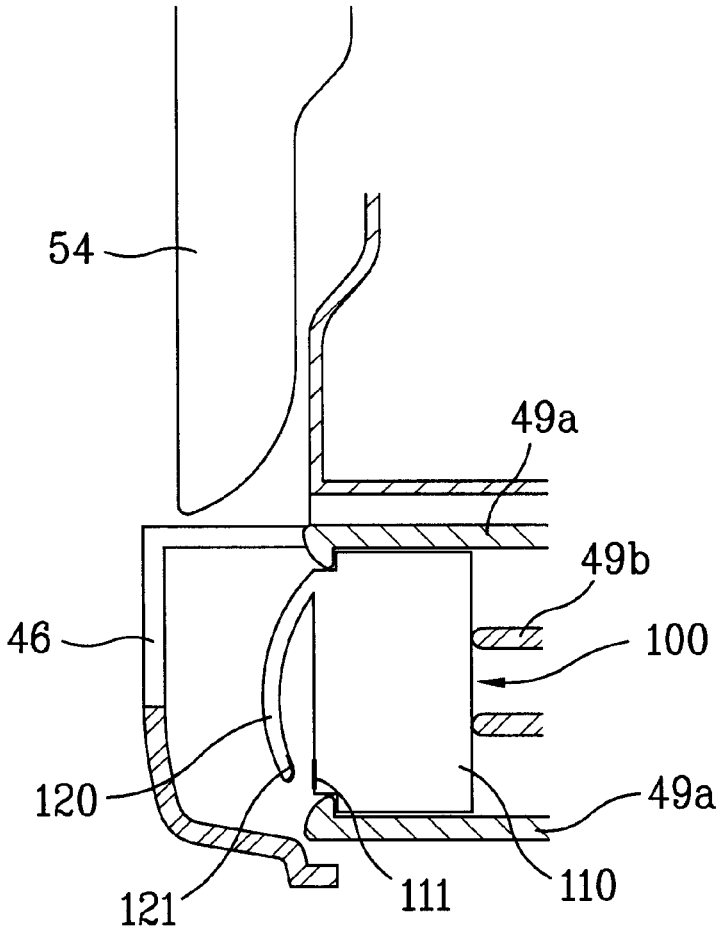

In the above power control means, when the intake panel 50 is loaded, the protrusion 54, as shown in FIG. 10A, pressurizes the terminal 120. As the other end of the terminal 120 is contacted with the body 110, the contact points 111 and 121 are connected to each other so as to supply the inner components with power. Since the protrusion 54 maintains to be contacted with the terminal 120 while the intake panel 50 revolves, as shown in FIG. 10B, the supply of the power is kept on. Meanwhile, if the intake panel 50 is detached, the protrusion 54, as shown in FIG. 10C, is separated from the penetrating hole 46 so as to release the terminal 120. Hence, the terminal 120 restored by its own elasticity to separate the contact points 111 and 121 from each other so as to cut off the power supply to the inner components.

Meanwhile, the blow outlet 14 is formed at the bottom of the indoor unit for improving the exterior and cooling a lower area right under the indoor unit. Yet, such a blow outlet 14 is not suitable for blowing a chill air into the entire room evenly. In order to provide an even cooling, the indoor unit according to the present invention further includes blow means 80 and 90 inserted inside or drawn out from the main chassis 10 so as to blow the heat-exchanged air into the room.

Figure 11A:
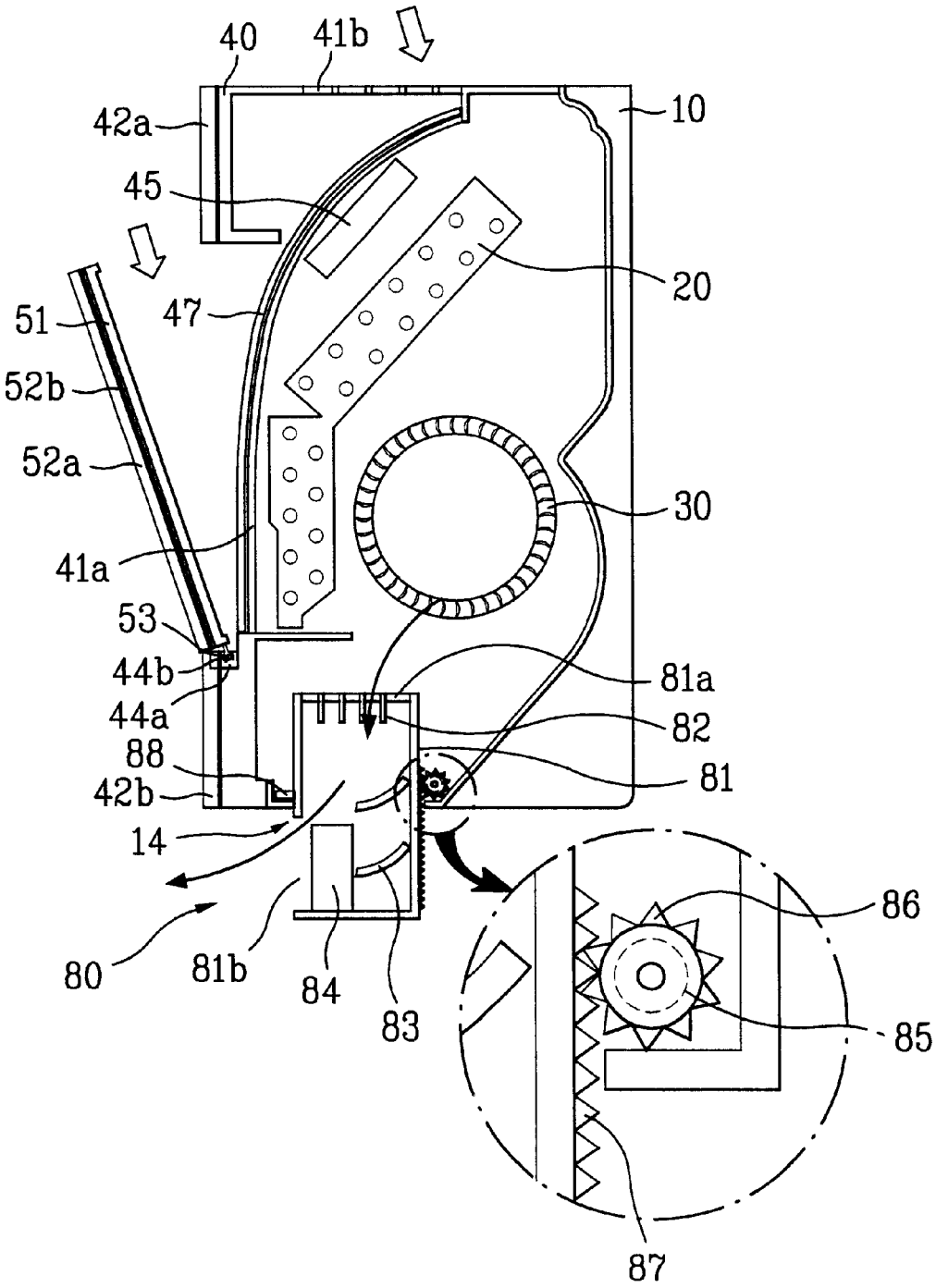
FIG. 11A and FIG. 11B illustrate partially open and bird's-eye views of a blow means of an air conditioner according to a first embodiment of the present invention.

The blow means 80 according to a first embodiment, as shown in FIG. 11A, is drawn in or out along the blow outlet 14 upward and downward so as to open/close the blow outlet 14 selectively. For this, a blow housing 81 is installed inside the main chassis 10 so as to move upward and downward along the blow outlet 14. The blow housing 81 is drawn outside in part through the blow outlet 14 in accordance with a degree of the descent. And, an auxiliary intake inlet 81*a* through which the heat-exchanged air is sucked in and an auxiliary blow outlet 81*b* connected to the room are formed at the blow housing 81.

The blow housing 81 has a rectangular shape of which right/left width is longer than a front/rear width, and the auxiliary blow outlets 81*a* and 81*b* are formed at an upper face and a lower front face of the blow housing, respectively. Once the blow housing 81 is lifted upward so as to be completely inserted inside the main chassis 10, the blow outlet 14 is closed by the blow housing 81. When the blow housing 81 is moved downward for some distance so as to draw out the auxiliary outlet 81*b* outside, the blow outlet 14 becomes open.

In this case, a member controlling a blow direction of an air is preferably installed inside the blow housing 81. For this, a vane 83 controlling the blow direction of the air upward and downward and a louver 84 controlling the blow direction of the air right and left are installed inside the blow housing 81. Preferably, an auxiliary intake grill 82 is formed at the auxiliary intake inlet 81*a* so as to guide a smooth airflow.

Meanwhile, the blow housing 81 can be lifted by a direct user's operation. Instead, it is preferable that the blow housing 81 is lifted automatically in accordance with the operation of the air conditioner. For this, a driving means for elevating the blow housing 81 automatically is further installed.

The driving means includes a motor 85 receiving a power to generate a turning force, a pinion 86 connected to a driving shaft of the motor 85, and a rack 87 installed at a rear wall of the blow housing 81 in upper/lower direction so as to gear into the pinion 86. In the drawing, it is shown that the driving means is installed in rear of the blow housing 81. Instead, it is preferable that the driving means is installed at a lateral side of the blow housing 81.

In order to prevent the blow housing from being separated from the main chassis 10 completely, a stopper 88 is installed at a front wall of the blow housing 81. Once the blow housing 81 is moved downward with a predetermined distance, the stopper 88 is caught on the bottom of the main chassis 10 so as to fail to move downward no more.

Figure 12A:
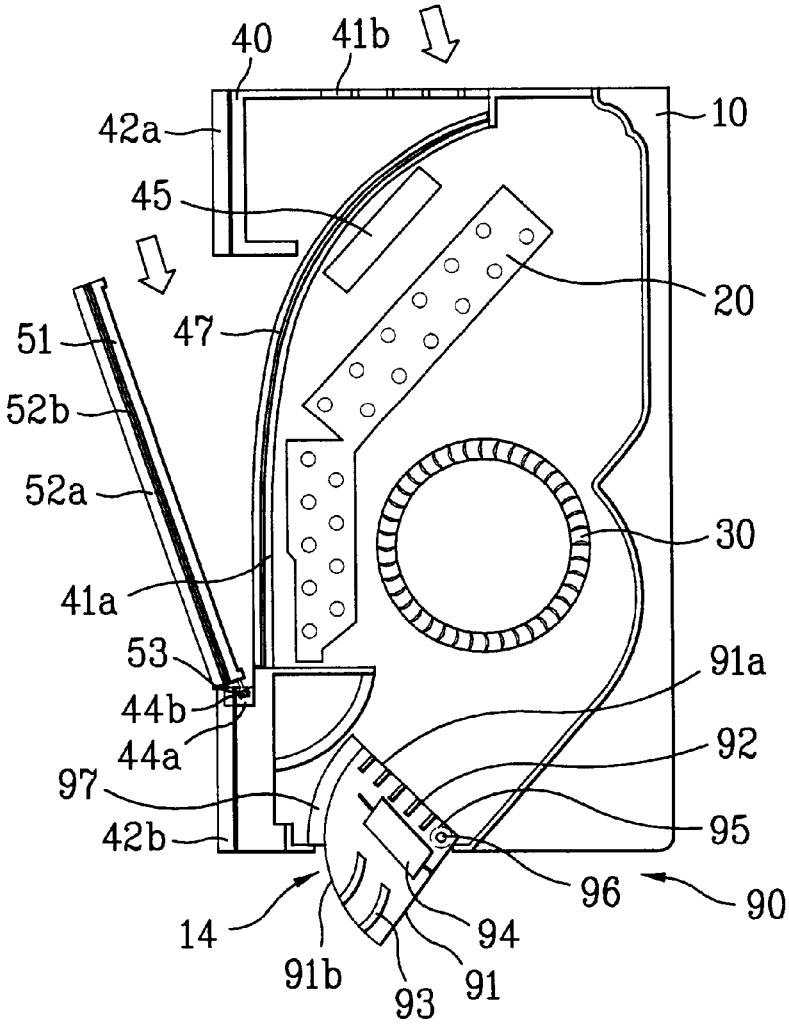
FIG. 12A and FIG. 12B illustrate partially open and bird's-eye views of a blow means of an air conditioner according to a second embodiment of the present invention.

Moreover, a second embodiment 90 of the blow means, as shown in FIG. 12A, revolves to move inside the blow inlet 14 so as to close/open the blow outlet 14 selectively. For this, a blow housing 91 having a revolution center near the blow outlet 14 is installed at the bottom face of the main chassis 10 so as to revolve to move to be drawn outside through the blow outlet 14. In this case, an auxiliary intake inlet 91*a* through which the heat-exchanged air is sucked in and an auxiliary blow outlet 91*b* connected to the room are formed at the blow housing 91.

The blow housing 91 has a fan-shape cross-section, and the auxiliary intake inlet 91*a* and auxiliary blow outlet 91*b* are formed at an upper face and a lower circumferential face of the blow housing 91, respectively. In this case, a rotating shaft 96 of the blow housing 91 is formed near a vertex of the fan-shape cross-section. If the blow housing 91 revolves clockwise centering around the rotating shaft 96 so as to be inserted inside the main chassis 10 completely, the blow outlet 14 is closed by the blow housing 91. On the contrary, if the blow housing 91 revolves counterclockwise so as to draw out the auxiliary blow outlet 91*b* outside, the blow outlet 14 becomes open. Namely, the inner space of the main chassis 10 leads to the room through the auxiliary intake inlet 91*a* and auxiliary blow outlet 91*b*.

A vane 93 adjusting a blow direction of the heat-exchanged air upward and downward and a louver 94 adjusting the blow direction right and left are installed inside the blow housing 91. And, an auxiliary intake grill 92 is further installed at the auxiliary intake inlet 91*a* so as to guide airflow more smoothly.

And, a stopper 97 is installed at an upper circumferential face of the blow housing 91 so as to restrict a revolution angle of the blow housing 91. Once the blow housing 91 revolves with a predetermined degree, the stopper 97 is caught on a lower face of the main chassis 10 so that the blow housing is unable to revolve any more.

Meanwhile, it is preferable that the blow housing 91 revolves to move automatically in accordance with the operation of the air conditioner as well. For this, a driving means revolving the blow housing 91 automatically is further installed at the blow means 90. The driving means is a motor 95 generating a turning force by receiving a power, and a driving shaft of the motor 95 is directly connected to the rotating shaft 96 of the blow housing 91.

Operation of the above-constituted air conditioner according to the present invention is explained by referring to the relating drawings as follows.

First of all, once the air conditioner is actuated, as shown in FIG. 8A and FIG. 8B, the first link 71 starts to revolve by the motor 73 toward a front side of the indoor unit as well as the second link 72 follows the first link 71 to revolve. During the revolution of the first and second links 71 and 72, if the stopper 76 is formed at the first link 71, the stopper 76, as shown in FIG. 8B, is caught on the second link 72 so that the second link 72 is restricted by the first link 71. The first and second links 71 and 72 then push the second link 72 toward the intake panel 72 without reciprocal revolution between the first and second links 71 and 72, thereby securing the stable revolution of the intake panel 50. Moreover, the auxiliary connecting members 74 and 75 maintain the connected state of the first and second links 71 and 72 for the revolution of the intake panel. By the operation of the driving means 71 to 76, the intake panel 62, as shown in FIG. 3B and FIG. 4B, keeps on revolving continuously centering around its lower end and is arranged to incline to the front panel 40 with a predetermined angle so as to open the main intake inlet 41*a* of the front panel 40.

Figure 11B:
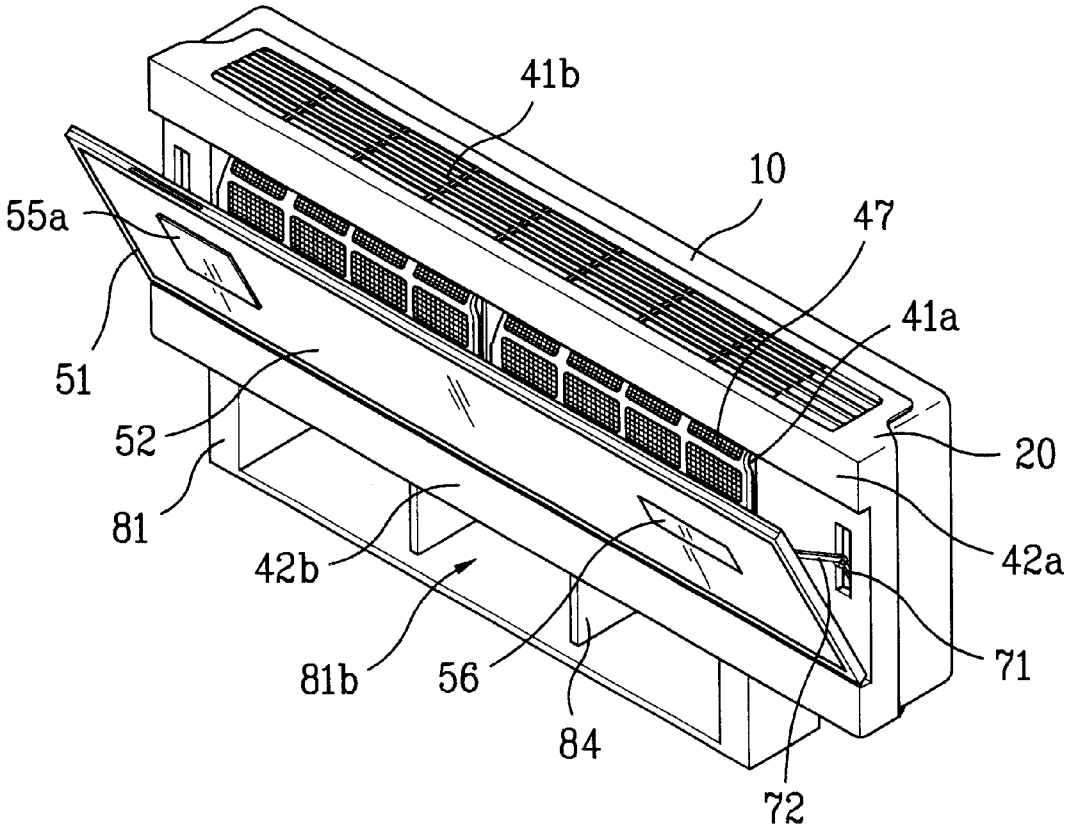

Simultaneously, in the first embodiment 80 of the blow means, the blow housing 81 descends by reciprocal reaction between the pinion 86 and rack 87 when a power is applied to the motor 85, which is shown in FIG. 11B. Hence, the descent of the blow housing 81 makes the blow outlet 14 open. Namely, the inner space of the main chassis 10 leads to the room through the auxiliary intake inlet 81*a* and auxiliary blow outlet 81*b*.

Figure 12B:
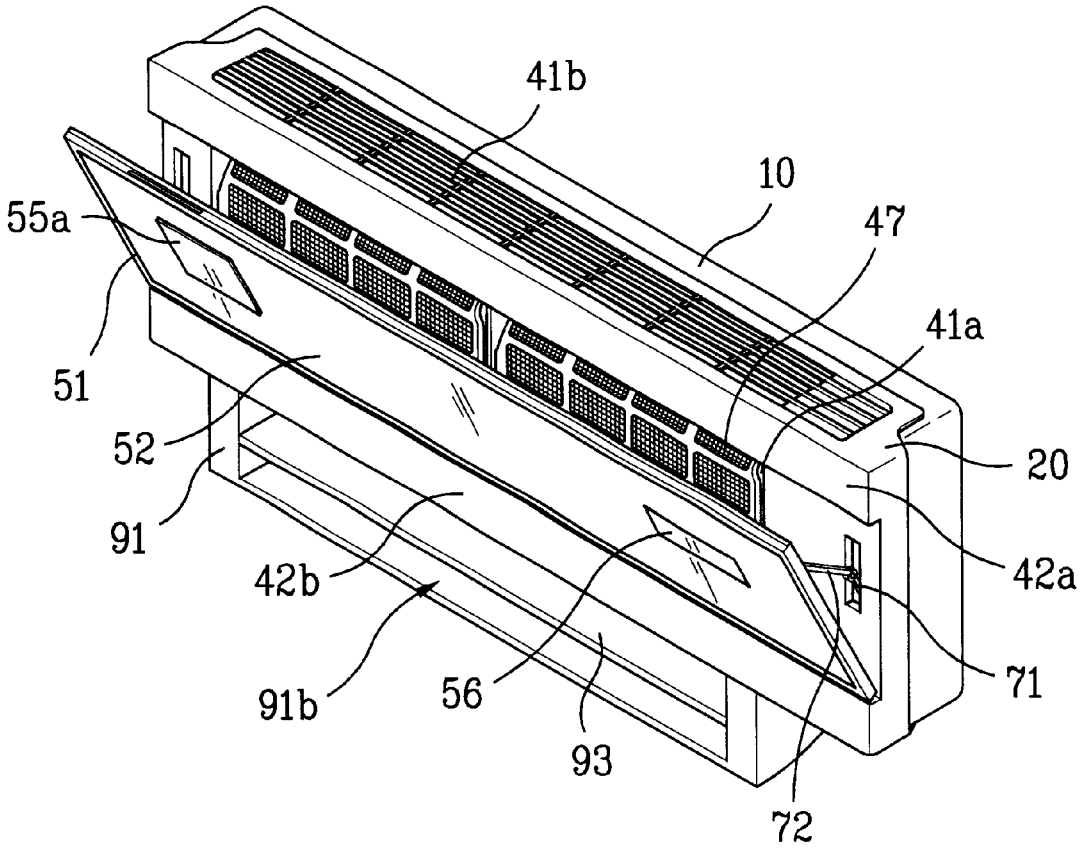

Moreover, in the second embodiment 90 of the blow means, a power is applied to the motor 95 so as to revolve the blow housing 91 the moment the intake panel 50 revolves, which is shown in FIG. 12B. Hence, the revolution of the blow housing 91 makes the blow outlet 14 open.

Once the main intake inlet 41*a* and blow outlet 14 become open, the blow fan 30 starts to revolve by the fan motor 31 so that the room air is sucked inside the indoor unit through the main and auxiliary intake inlets 41*a* and 41*b*. During such an intake process, the intake panel 50 opens the main intake inlet 41*a* overall so as to suck in air more than the blow grill of the related art do. Moreover, the tilt angle of the intake panel 50 is adjusted so as to control the interval between the intake panel 50 and front panel. Such an interval control enables to control the air blow amount as well as the air intake amount. The intake air passes the air filter 47 so as to remove large particles, and then passes the electrostatic precipitator 45 so as to precipitate minute particles such as dust and the like. Subsequently, the air passes the heat exchanger 20 for heat exchange with the refrigerant so as to be cooled, and then moves toward the blow outlet 14.

Thereafter, the cooled air, as shown in FIG. 11A or FIG. 12A, flows inside the blow housing 81 or 91 through the auxiliary intake inlet 81*a* or 81*b*. The cooled air is then guided by the vane 83 or 93 and louver 84 or 94 so as to be blown into the room through the auxiliary blow outlet 81*b* or 91*b*. During such a blow process, the intake panel 50 is tilted between the main intake inlet 41*a* and auxiliary blow outlet 81*b* or 91*b* so as to work as the partition dividing the space therebetween. Hence, the interference between the intake and blow is excluded so as to prevent the blow air fails to be sucked in through the main intake inlet 41*a* again. Moreover, since the blow housing 81 or 91 is drawn out from the main chassis 10 downwardly, the cooled air can be blown into the entire area of the room evenly as well as the area under the indoor unit.

Once the air conditioner stops operating after having operated for a predetermined time, the fan motor 31, blow fan 31, and heat exchanger 20 stop operating. Thereafter, the intake panel 50 and blow housing 81 or 91, as shown in FIG. 3A and FIG. 3B, operate in order reverse to the foregoing explanation so as to close the main intake inlet 41*a* and blow outlet 14.

Referring to FIG. 9A and FIG. 9B, when a user turns the intake panel 50 a little bit and then lifts the intake panel 50 upward, the hinge ring 53 at the lower end of the intake panel 50 is separated from the hinge bar 44*b* by its opening portion 53*a*. Thus, the intake panel 50 is separated from the front panel 50 with ease.

Once the intake panel 50 is laid down to be hung through the first and second links 71 and 72 so as to be positioned under the front panel 56, the main intake inlet 41*a* is fully opened. When the main intake inlet 41*a* is open, the second link 71 is caught on the stopper 76 so as to revolve no more than 180° for the first link 71. And, the intake panel 50, as shown in the drawing, is hung so as to be left apart with a predetermined interval from the lower portion of the front panel 40. Hence, the intake panel 50 is free from causing damage on the lower portion of the front panel 40 when being attached to or detached from. Moreover, the moment the intake panel 50 is separated, as shown in FIG. 10C, the protrusion 54 is detached from the penetrating hole 46 so that the contact points 111 and 121 are separated from each other. The power supply becomes cut off to the inner components, whereby the user is protected from an electric shock.

Therefore, the user separates the intake panel 50, thereby enabling to disassemble conveniently the inner components such as air filter 47, electrostatic precipitator 45, and the like through the fully opened main intake inlet 41*a* for cleaning and replacement. Moreover, since the separated intake panel 50 is hung on the indoor unit, the user enables to reload the intake panel 50 conveniently after loading the inner components 45 and 47.

Accordingly, the present invention has the following effects or advantages.

The present invention uses a flat panel type intake panel instead of the blow grill of the related art, thereby providing a compact size of the indoor unit as well as improving the exterior. And, the intake panel closes the intake inlet on stopping operation, thereby preventing particles from flowing inside the air conditioner.

Moreover, since the intake panel inclines to the front panel on operation, the intake inlet fails to be exposed to a user so as to improve the exterior of the indoor unit. And, the tilted front panel excludes the interference between the intake and blow airflows, thereby improving heat exchange efficiency. Besides, the tilt angle of the intake panel is adjusted so as to control intake and blow air amounts.

Since the intake panel is detachable, it is easy to manage the inner components such as the air filter, electrostatic precipitator, and the like. Since the intake panel is dangled from the indoor unit, the user enables to reload the intake panel conveniently.

Besides, the present invention includes the blow means drawn out from the bottom of the indoor unit, thereby enabling to blow the chill air to all over the room evenly as well as the area right under the indoor unit.

It will be apparent to those skilled in the art than various modifications and variations can be made in the present invention. Thus, it is intended that the present invention covers the modifications and variations of this invention provided they come within the scope of the appended claims and their equivalents.

What is claimed is:

1. An air conditioner comprising:

a main chassis receiving various components inside;

a heat exchanger installed inside the main chassis so as to exchange heat with a room air;

a blow fan installed inside the main chassis so as to suck in and blow out the room air;

a front panel attached to a front side of the main chassis and having an intake inlet at a front face so as to make an air flow in the heat exchanger; and an intake panel installed at the front face of the front panel to revolve to move so as to close/open the intake inlet selectively, the intake panel installed at the front face of the front panel so as to be detachable.

2. The air conditioner of claim 1, wherein a lower end of the intake panel is loaded on a lower portion of the front panel so as to revolve to move.

3. The air conditioner of claim 1, wherein the intake panel maintains a predetermined tilt angle for the front panel on operation.

4. The air conditioner of claim 1, further comprising a blow means installed at the main chassis so as to blow the heat-exchanged air into a room by being drawn inside or outside the main chassis.

5. The air conditioner of claim 1, wherein the main chassis further comprises a blow outlet formed at a bottom face.

6. The air conditioner of claim 1, wherein the main chassis further comprises a front part and a rear part installed at a wall face so as to lead to the front part.

7. An air conditioner comprising:

a main chassis receiving various components inside;

a heat exchanger installed inside the main chassis so as to exchange heat with a room air;

a blow fan installed inside the main chassis so as to suck in and blow out the room air;

a front panel attached to a front side of the main chassis and having an intake inlet at a front face so as to make an air flow in the heat exchanger; and an intake panel installed at the front face of the front panel to revolve to move so as to close/open the intake inlet selectively, the intake panel installed at the front face of the front panel so as to be detachable, wherein the intake panel comprises a main plate and an auxiliary plate attached to a front face of the main plate.

8. The air conditioner of claim 7, the auxiliary plate comprising:

a first layer transmitting light; and a second layer placed at a rear face of the first layer so as to reflect light.

9. The air conditioner of claim 8, wherein the first layer of the auxiliary plate is made of one selected from a group consisting of tempered glass and plastics.

10. The air conditioner of claim 8, wherein the second layer of the auxiliary plate is selected from a group consisting of a metal layer and dielectric multi-layers.

11. The air conditioner of claim 10, wherein the second layer is colored with a predetermined color.

12. The air conditioner of claim 7, wherein the auxiliary plate includes various patterns and colors.

13. An air conditioner comprising:

a main chassis receiving various components inside;

a heat exchanger installed inside the main chassis so as to exchange heat with a room air;

a blow fan installed inside the main chassis so as to suck in and blow out the room air;

a front panel attached to a front side of the main chassis and having an intake inlet at a front face so as to make an air flow in the heat exchanger; and an intake panel installed at the front face of the front panel to revolve to move so as to close/open the intake inlet selectively, the intake panel installed at the front face of the front panel so as to be detachable, wherein the intake panel further comprises a driving means connecting the front panel and the intake panel to each other when the intake panel is detached and revolving the intake panel up to a limited range on operation.

14. The air conditioner of claim 13, the driving means comprising:

a first link having a first end portion connected to the front panel to move to revolve; and a second link having a first end portion connected to a second end portion of the first link confronting the first end portion of the first link and a second end portion connected to the intake panel so as to revolve to move.

15. The air conditioner of claim 14, a connecting unit of the first and second links, comprising:

a hinge hole formed one of the second end portion of the first link and the first end portion of the second link; and a hinge pin formed at the other end portion connected to the end portion having the hinge hole so as to be inserted in the hinge hole.

16. The air conditioner of claim 14, a connecting unit of the second link and intake panel, comprising:

a bracket formed at a rear face of the intake panel and having a hinge hole; and a hinge pin inserted in the hinge hole at the second end portion of the second link, the hinge hole of the bracket, and the hinge hole of the second link, simultaneously.

17. The air conditioner of claim 14, wherein the driving means further comprises a motor connected to the first end portion of the first link so as to revolve the first link automatically.

18. The air conditioner of claim 17, wherein the motor is a step motor enabling to control a revolution degree of the first link step by step.

19. The air conditioner of claim 17, wherein the motor is attached to a rear face of the front panel and the first link is connected to a shaft of the motor through an opening formed at the front panel.

20. The air conditioner of claim 19, wherein the front panel further comprises a partition formed near the opening so as to protect the inner components.

21. The air conditioner of claim 20, wherein the partition extends from a circumference of the opening toward a rear side of the front panel in a direction vertical to the front face of the front panel.

22. The air conditioner of claim 14, wherein the driving means further comprises an auxiliary connecting member formed at the connecting unit of the first and second links so as to prevent separation of the first and second links.

23. The air conditioner of claim 22, wherein the auxiliary connecting member is formed at one of a group consisting of the second end portion of the first link and the first end portion of the second link so as to surround the other connected end portion in part.

24. The air conditioner of claim 22, the auxiliary connecting member comprising:

a boss formed near one of the second end portion of the first link and the first end portion of the second link; and a coupling member coupled with the boss so as to gear into the other end portion connected to the end portion having the boss.

25. The air conditioner of claim 14, wherein the driving means further comprises a stopper formed at the connecting unit of the first and second links so as to restrict a reciprocal revolution range between the first and second links.

26. An air conditioner comprising:

a main chassis receiving various components inside;

a heat exchanger installed inside the main chassis so as to exchange heat with a room air;

a blow fan installed inside the main chassis so as to suck in and blow out the room air;

a front panel attached to a front side of the main chassis and having an intake inlet at a front face so as to make an air flow in the heat exchanger;

an intake panel installed at the front face of the front panel to revolve to move so as to close/open the intake inlet selectively, the intake panel installed at the front face of the front panel so as to be detachable, a loading unit of the intake and front panels, comprising:

a hinge bar formed at a lower side of the front panel; and a hinge ring protruding from a lower end of the intake panel so as to be coupled with the hinge bar detachably.

27. An air conditioner comprising:

a main chassis receiving various components inside;

a heat exchanger installed inside the main chassis so as to exchange heat with a room air;

a blow fan installed inside the main chassis so as to suck in and blow out the room air;

a front panel attached to a front side of the main chassis and having an intake inlet at a front face so as to make an air flow in the heat exchanger;

an intake panel installed at the front face of the front panel to revolve to move so as to close/open the intake inlet selectively, the intake panel installed at the front face of the front panel so as to be detachable; and a power control means for cutting off a power to the inner components when the intake panel is separated.

28. The air conditioner of claim 27, the power control means comprising:

a protrusion formed at a lower end of the intake panel so as to be inserted in a hole formed at the front panel on loading a panel; and a switch fixed to the front panel by a predetermined fixing member so as to supply a power by being contacted with the protrusion.

29. The air conditioner of claim 28, wherein a contact area between the protrusion and the switch is a curved face.

30. The air conditioner of claim 28, the switch comprising:

a body having an electrical contact point; and a terminal having one end connected to the body and the other end contacted with the contact point of the body when being pressurized.

31. The air conditioner of claim 28, the fixing member comprising:

a hook formed inside the front panel so as to be adjacent to a recess for the protrusion wherein the switch is inserted in the hook; and a plurality of ribs supporting the switch.

32. An air conditioner comprising:

a main chassis receiving various components inside;

a heat exchanger installed inside the main chassis so as to exchange heat with a room air;

a blow fan installed inside the main chassis so as to suck in and blow out the room air;

a front panel attached to a front side of the main chassis and having an intake inlet at a front face so as to make an air flow in the heat exchanger; and an intake panel installed at the front face of the front panel to revolve to move so as to close/open the intake inlet selectively, the intake panel installed at the front face of the front panel so as to be detachable, the intake panel hung on the front panel when being detached.

33. The air conditioner of claim 32, wherein a lower end of the intake panel is loaded on a lower portion of the front panel so as to revolve to move.

34. The air conditioner of claim 32, wherein the intake panel maintains a predetermined tilt angle for the front panel on operation.

35. The air conditioner of claim 32, further comprising a blow means installed at the main chassis so as to blow the heat-exchanged air into a room by being drawn inside or outside the main chassis.

36. The air conditioner of claim 32, wherein the main chassis further comprises a blow outlet formed at a bottom face.

37. The air conditioner of claim 32, wherein the main chassis further comprises a front part and a rear part installed at a wall face so as to lead to the front part.

38. An air conditioner comprising:

a main chassis receiving various components inside;

a heat exchanger installed inside the main chassis so as to exchange heat with a room air;

a blow fan installed inside the main chassis so as to suck in and blow out the room air;

a front panel attached to a front side of the main chassis and having an intake inlet at a front face so as to make an air flow in the heat exchanger; and an intake panel installed at the front face of the front panel to revolve to move so as to close/open the intake inlet selectively, the intake panel installed at the front face of the front panel so as to be detachable, the intake panel hung on the front panel when being detached, wherein the intake panel comprises a main plate and an auxiliary plate attached to a front face of the main plate.

39. The air conditioner of claim 38, the auxiliary plate comprising:

a first layer transmitting light; and a second layer placed at a rear face of the first layer so as to reflect light.

40. The air conditioner of claim 39, wherein the first layer of the auxiliary plate is made of one selected from a group consisting of tempered glass and plastics.

41. The air conditioner of claim 39, wherein the second layer of the auxiliary plate is selected from a group consisting of a metal layer and dielectric multi-layers.

42. The air conditioner of claim 41, wherein the second layer is colored with a predetermined color.

43. The air conditioner of claim 38, wherein the auxiliary plate includes various patterns and colors.

44. An air conditioner comprising:

a main chassis receiving various components inside;

a heat exchanger installed inside the main chassis so as to exchange heat with a room air;

a blow fan installed inside the main chassis so as to suck in and blow out the room air;

a front panel attached to a front side of the main chassis and having an intake inlet at a front face so as to make an air flow in the heat exchanger; and an intake panel installed at the front face of the front panel to revolve to move so as to close/open the intake inlet selectively, the intake panel installed at the front face of the front panel so as to be detachable, the intake panel hung on the front panel when being detached, wherein the intake panel further comprises a driving means connecting the front panel and the intake panel to each other when the intake panel is detached and revolving the intake panel up to a limited range on operation.

45. The air conditioner of claim 44, the driving means comprising:

a first link having a first end portion connected to the front panel to move to revolve; and a second link having a first end portion connected to a second end portion of the first link confronting the first end portion of the first link and a second end portion connected to the intake panel so as to revolve to move.

46. The air conditioner of claim 45, a connecting unit of the first and second links, comprising:

a hinge hole formed one of the second end portion of the first link and the first end portion of the second link; and a hinge pin formed at the other end portion connected to the end portion having the hinge hole so as to be inserted in the hinge hole.

47. The air conditioner of claim 45, a connecting unit of the second link and intake panel, comprising:

a bracket formed at a rear face of the intake panel and having a hinge hole; and a hinge pin inserted in the hinge hole at the second end portion of the second link, the hinge hole of the bracket, and the hinge hole of the second link, simultaneously.

48. The air conditioner of claim 45, wherein the driving means further comprises a motor connected to the first end portion of the first link so as to revolve the first link automatically.

49. The air conditioner of claim 48, wherein the motor is a step motor enabling to control a revolution degree of the first link step by step.

50. The air conditioner of claim 48, wherein the motor is attached to a rear face of the front panel and the first link is connected to a shaft of the motor through an opening formed at the front panel.

51. The air conditioner of claim 50, wherein the front panel further comprises a partition formed near the opening so as to protect the inner components.

52. The air conditioner of claim 51, wherein the partition extends from a circumference of the opening toward a rear side of the front panel in a direction vertical to the front face of the front panel.

53. The air conditioner of claim 45, wherein the driving means further comprises an auxiliary connecting member formed at the connecting unit of the first and second links so as to prevent separation of the first and second links.

54. The air conditioner of claim 53, wherein the auxiliary connecting member is formed at one selected from a group consisting of the second end portion of the first link and the first end portion of the second link so as to surround the other connected end portion in part.

55. The air conditioner of claim 53, the auxiliary connecting member comprising:

a boss formed near one of the second end portion of the first link and the first end portion of the second link; and a coupling member coupled with the boss so as to gear into the other end portion connected to the end portion having the boss.

56. The air conditioner of claim 55, wherein the driving means further comprises a stopper formed at the connecting unit of the first and second links so as to restrict a reciprocal revolution range between the first and second links.

57. An air conditioner comprising:

a main chassis receiving various components inside;

a heat exchanger installed inside the main chassis so as to exchange heat with a room air;

a blow fan installed inside the main chassis so as to suck in and blow out the room air;

a front panel attached to a front side of the main chassis and having an intake inlet at a front face so as to make an air flow in the heat exchanger;

an intake panel installed at the front face of the front panel to revolve to move so as to close/open the intake inlet selectively, the intake panel installed at the front face of the front panel so as to be detachable, the intake panel hung on the front panel when being detached; and a loading unit of the intake and front panels, comprising:

a hinge bar formed at a lower side of the front panel; and a hinge ring protruding from a lower end of the intake panel so as to be coupled with the hinge bar detachably.

58. An air conditioner comprising:

a main chassis receiving various components inside;

a heat exchanger installed inside the main chassis so as to exchange heat with a room air;

a blow fan installed inside the main chassis so as to suck in and blow out the room air;

a front panel attached to a front side of the main chassis and having an intake inlet at a front face so as to make an air flow in the heat exchanger;

an intake panel installed at the front face of the front panel to revolve to move so as to close/open the intake inlet selectively, the intake panel installed at the front face of the front panel so as to be detachable, the intake panel hung on the front panel when being detached; and a power control means for cutting off a power to the inner components when the intake panel is separated.

59. The air conditioner of claim 58, the power control means comprising:

a protrusion formed at a lower end of the intake panel so as to be inserted in a hole formed at the front panel on loading a panel; and a switch fixed to the front panel by a predetermined fixing member so as to supply a power by being contacted with the protrusion.

60. The air conditioner of claim 59, wherein a contact area between the protrusion and the switch is a curved face.

61. The air conditioner of claim 59, the switch comprising:

a body having an electrical contact point; and a terminal having one end connected to the body and the other end contacted with the contact point of the body when being pressurized.

62. The air conditioner of claim 59, the fixing member comprising:

a hook formed inside the front panel so as to be adjacent to a recess for the protrusion wherein the switch is inserted in the hook; and a plurality of ribs supporting the switch.

* * * * *